US007772518B2

(12) United States Patent
Rajesh et al.

(10) Patent No.: US 7,772,518 B2
(45) Date of Patent: Aug. 10, 2010

(54) REINFORCED CAN END—CAN BODY JOINTS WITH LASER SEAMING

(75) Inventors: Gopalaswamy Rajesh, Lake Zurich, IL (US); Michael R. Gogola, Itasca, IL (US); Timothy L. Turner, Pecatonica, IL (US)

(73) Assignee: Rexam Beverage Can Company, Chicago, IL (US)

( * ) Notice: Subject to any disclaimer, the term of this patent is extended or adjusted under 35 U.S.C. 154(b) by 1468 days.

(21) Appl. No.: 11/063,430

(22) Filed: Feb. 22, 2005

(65) Prior Publication Data

US 2006/0186127 A1 Aug. 24, 2006

(51) Int. Cl.
*B23K 26/20* (2006.01)
*B21D 51/32* (2006.01)

(52) U.S. Cl. ..... 219/121.64; 220/620; 413/6

(58) Field of Classification Search ..... 219/121.64; 413/27, 31, 6; 220/620, 689, 906
See application file for complete search history.

(56) References Cited

U.S. PATENT DOCUMENTS

| | | | | |
|---|---|---|---|---|
| 291,557 | A | 1/1884 | Walker | |
| 368,348 | A | 8/1887 | Miller | |
| 377,495 | A | 2/1888 | Miller | |
| 2,043,339 | A | 6/1936 | Strickler | 220/66 |
| 2,354,921 | A | 8/1944 | McClary | 113/121 |
| 3,306,488 | A | 2/1967 | Lemelson | 220/63 |
| 3,550,832 | A | 12/1970 | Fitzgerald | 220/67 |
| 4,152,573 | A | 5/1979 | Saurin et al. | 219/121 |
| 4,231,488 | A | 11/1980 | Ward et al. | 220/288 |
| 4,392,295 | A * | 7/1983 | Sasai et al. | 220/620 |
| 4,540,323 | A * | 9/1985 | Inoue et al. | 413/6 |
| 4,738,560 | A | 4/1988 | Brussow | 403/268 |
| 4,758,704 | A | 7/1988 | Kögel | 219/121.64 |
| 4,854,467 | A | 8/1989 | Büdenbender | 220/67 |
| 4,905,858 | A | 3/1990 | Büdenbender | 220/67 |

(Continued)

FOREIGN PATENT DOCUMENTS

DE 3447771 7/1986

(Continued)

OTHER PUBLICATIONS

Published Invitation to Pay Additional Fees Communication Relating to the Results of the Partial International Search for PCT Application PCT/US2006/005728 application of Rexam Beverage Can Company published Jun. 23, 2006.

*Primary Examiner*—Geoffrey S Evans
(74) *Attorney, Agent, or Firm*—McDonnell Boehnen Hulbert & Berghoff LLP

(57) ABSTRACT

A can end and can body are seamed to each other using a seaming roller, seaming chuck and a laser fusing the peripheral portion of the can end to the can body. Laser seaming allows less metal to be used in the can end and can body. The can end and can body seam is further reinforced in order to ensure that the can is capable of withstanding internal pressures. The reinforcing techniques include crimping the seam with one or more crimping rollers, reforming the seam so as to incline the seam towards a central axis extending through the center of the can end and can body, and using multiple laser welds spaced apart from each other in the vicinity of the seam.

5 Claims, 22 Drawing Sheets

U.S. PATENT DOCUMENTS

| | | | | | |
|---|---|---|---|---|---|
| 4,948,006 | A | | 8/1990 | Okabe et al. | 220/611 |
| 5,022,552 | A | | 6/1991 | Kars | 220/288 |
| 5,100,014 | A | | 3/1992 | Shiozawa | 220/256 |
| 5,115,938 | A | * | 5/1992 | Thompson | 220/620 |
| 5,125,780 | A | | 6/1992 | Büdenbender | 413/4 |
| 5,181,615 | A | * | 1/1993 | Thompson | 220/620 |
| 5,186,592 | A | | 2/1993 | Büdenbender | 413/2 |
| 5,249,701 | A | | 10/1993 | Daehin | 220/612 |
| 5,279,693 | A | * | 1/1994 | Robinson et al. | 219/121.64 |
| 5,513,767 | A | | 5/1996 | Daehin | 220/89.2 |
| 5,647,504 | A | | 7/1997 | Gullett et al. | 220/612 |

FOREIGN PATENT DOCUMENTS

| | | | | | |
|---|---|---|---|---|---|
| DE | 3600532 | | | 10/1986 | |
| DE | 3802000 | | | 10/1988 | 413/26 |
| DE | 3902163 | | | 6/1990 | 413/26 |
| EP | 0133826 | | | 3/1985 | |
| EP | 0177945 | | | 4/1986 | |
| EP | 0199279 | | | 10/1986 | |
| EP | 0200098 | | | 11/1986 | |
| FR | 2543923 | | | 10/1984 | 220/611 |
| FR | 2585332 | A | * | 1/1987 | |
| GB | 2264252 | | | 8/1993 | |
| JP | 359061538 | | | 4/1984 | 416/8 |
| JP | 359166332 | | | 9/1984 | 413/74 |
| JP | 1299787 | | | 12/1989 | |
| JP | 2-200327 | A | * | 8/1990 | |
| JP | 2000-238788 | A | * | 9/2000 | |
| WO | WO 0242196 | | | 5/2002 | |

* cited by examiner

REINFORCED CAN END—CAN BODY JOINTS WITH LASER SEAMING

BACKGROUND OF THE INVENTION

A. Field of the Invention

This invention relates to the can manufacturing art, and more particularly to a novel construction and arrangement of the joint or seam which connects a can body to a can end, and to a method of affixing a can body to a can end.

B. Description of Related Art

It is well known to draw and iron a sheet metal blank to make a thin-walled can body for packaging beverages, such as beer, fruit juice or carbonated beverages. In a typical manufacturing method for making a drawn and ironed can body, a circular disk or blank is cut from a sheet of light gauge metal (such as aluminum). The blank is then drawn into a shallow cup using a cup former. The cup is then transferred to a body maker where the can shape is formed. The body maker redraws and irons the sidewall of the cup to approximately the desired height, and forms dome and other features on the bottom of the can.

Can body manufacturing techniques are described in the patent literature. Representative patents include U.S. Pat. Nos. 6,305,210; 6,132,155; 6,079,244; 5,984,604, and 5,934,127, the contents of which are incorporated by reference herein. Domer assemblies for drawing and ironing machines are described in U.S. Pat. Nos. 4,179,909; 4,620,434; 4,298,014, all assigned to National Can Corporation, the contents of which are incorporated by reference herein.

In current practice, after the can is formed in the body maker, the can is sent to a separate necking and flanging station, where neck and flange features are formed on the upper region of the can. The flange is used as an attachment feature for permitting the lid for the can, known as an "end" in the art, to be seamed to the can. The last station in the necker-flanger is a reformer station. This station includes a set of tools for reforming the bottom profile of the can in order to increase the strength of the bottom profile. U.S. Pat. Nos. 5,222,385 and 5,697,242, both assigned to American National Can Co., describe a can body reforming apparatus and methods for reforming can bodies to increase the strength of the bottom profile. After necking, flanging and bottom reforming, the top edge of the can is trimmed and the can is ready to be shipped to the location of filling the can and attachment of the can end.

Can ends are subject to a separate manufacturing process. U.S. Pat. No. 6,533,518 and references cited therein describe several press designs used to form a can end from a sheet of end material.

At the time of filling the can with product, the end is placed over the can body and then attached to the can using a process known as seaming. FIGS. 1A and 1B are cross-sections showing a can end 10, can body 14, seam tooling comprising chuck 16 and seaming rollers 18 and 22, showing the flange 20 of the can body 14 and the curl 12 of the can end 10 before (FIG. 1A) and after (FIG. 1B) a double seaming operation, in accordance with a prior art double seam joint. The can end 10 has a peripheral curl 12 which is rolled against a peripheral flange 20 in the can body 14. The can end 10 is placed on top of the can body 14 and a seaming chuck 16 is inserted into the can end 10. A first roller 18 (FIG. 1A) is moved laterally into engagement with the curl 12 and presses the curl 12 against the flange 20 in a first seaming operation. In a second seaming operation, as shown in FIG. 1B, as second seaming roller 22 continues the seaming operation and presses the flange 20 and curl 12 together against the seaming chuck 16 to form a tight double seam joint 24 between the can end and the can body, as shown.

The art has proposed joining the can end to the can body using a combination of a rolling action and a laser weld which welds the can end and can body together in the area of the seam. See, for example, published PCT application of Williamson, publication no. WO 02/42196, the content of which is incorporated by reference. See also U.S. Pat. Nos. 5,186,592; 5,125,780 and 4,854,467 to Budenbender; U.S. Pat. No. 4,738,560 to Brussow, and U.S. Pat. No. 4,758,704 to Kogel, all incorporated by reference herein.

The potential for using a laser, in conjunction with a roller seam, offers the potential for a can and can body to be constructed using less metal for the same volume than that used in current practice. In particular, the laser seam approach may permit the can end to be joined to the can body in a single seam, which requires less metal in the peripheral curl of the can end and in the flange of the can body, whereas the current approach using a double seam (FIGS. 1A and 1B) requires more metal in the peripheral curl of the can end and in the flange of the can body. The prospect of laser seaming also has the potential for elimination of the application of a seam compound to the peripheral channel in the end, which seals the end can when the double seam is formed.

Despite the potential for metal utilization savings and elimination of joint compound, laser seaming has yet to be practiced in the beverage can art in this country. One concern with laser seaming with a single seam (as proposed in Williamson) is whether the seam design is sufficiently strong such that it will allow cans to be pressurized to 90 PSI or greater, which is currently a design standard for can designs in the beverage industry. There is a need for improvements in seam designs that provide for increased strength in the seam. This invention meets that need. It also provides improvements in seam designs that are particularly useful in combination with laser welding of the seam to increase the strength of the seam.

SUMMARY OF THE INVENTION

Several techniques are disclosed herein for further strengthening a seam joining a can end to a can body. While the techniques are specifically applicable to seams in which a laser is used to fuse to the can end to the can body, they may also be applicable to other seam arrangements in which a laser is not used. The seam strengthening techniques described herein can be used either singly or in combination with each other. In other words, there are a number of different combinations and permutations of specific seam strengthening techniques which can be used.

In a first embodiment, a method is provided for joining a can end to a can body and improving the strength of the joint between the can end and the can body. The method includes the steps of placing the end on the can body, performing a seaming operation so as to form a seam joining the end to the can body, and crimping the seam with one or more crimping rollers so as to further strengthen the seam. The particular seam arrangement between the can end and can body can take a variety of forms, as disclosed herein. In one embodiment, the method includes a further step of using a laser to weld the seam joining the can body to the can end, either before or after the performance of the seaming and crimping operations.

In a second embodiment, a method is provided for joining a can end to a can body and improving the strength of the joint between the can end and the can body. The method includes the steps of placing the end on the can body, performing a seaming operation so as to form a seam joining the end to the can body; and reforming the seam whereby the seam is inclined or tilted towards a central axis passing through the center of the can end and the can body so as to further strengthen the seam. The particular seam arrangement between the can end and can body can take a variety of forms, as disclosed herein. In one particular embodiment, the can body comprises a flange and the can end comprises a peripheral edge. During the seaming operation, the flange is folded inwards over the peripheral edge, and wherein a laser weld is applied to the flange and peripheral edge.

In a third embodiment, a method is provided for joining a can end to a can body and improving the strength of the joint between the can end and the can body. This particular embodiment uses multiple laser welds at the location of the seam. In particular, a method is provided for joining a can end to a can body. The method includes the steps of placing the end on the can body, performing a seaming operation so as to form a seam joining the end to the can body, and providing a plurality of welds spaced apart from each other joining the can end to the can body at the location of the seam to further strengthen the seam. The plurality of welds are preferably created with a laser. The welds are preferably formed after the performance of the seaming operation.

The three techniques described above (crimping, reforming, and multiple laser welds) can be performed on a variety of seam joints, including single and double seam joints. They can also be used in combination with each other. For example, a single seam joint can be both crimped, and reformed, or reformed and subject to multiple laser welds.

In another aspect, we have also provided a method of joining a can end to a can body which forms a smooth seam. The method includes the steps of (a) placing the end on the can body, wherein the can body comprises a flange and wherein the can end comprises a peripheral curl, (b) performing a seaming operation to form a seam joining the end to the can body, wherein during the seaming operation the peripheral curl is folded outwards over the flange, and wherein the flange and peripheral edge are folded such as to provide a double folded seam, and wherein (c) during the seaming operation of step (b), the peripheral curl is substantially folded under the flange to form a smooth seam. The resulting smooth seam avoids sharp edges at the seam and thus is more comfortable and safer if the beverage is consumed directly from the can. The seam of this embodiment can be strengthened in accordance with any of the strengthening techniques disclosed herein.

In still another aspect, a method of joining a can end to a can body is provided which provides for printing of messages on the can body which, after performance of the seaming operation, are visible to the consumer in the region of the seam itself. The advantage of this aspect is that it eliminates the need to provide incising or scoring of messages in the center panel of the can end (e.g., recycling messages) which tend to weaken the strength of the center panel, as such messaged can now be provided on the inside (or outside) surfaces of the seam. The printing is applied to the can body, which is already the subject of printing (e.g. colors, logos, and content information), and so no additional steps are required to provide the printing information to the consumer. In this aspect, the method comprises the step of placing the end on the can body, performing a seaming operation so as to form a seam joining the end to the can body; wherein the can body comprises a flange and wherein the can end comprises a peripheral edge, and wherein during the seaming operation the flange is folded inwards over the peripheral edge of the can end. The method continues with applying a printing to the can body in the vicinity of the flange, wherein, after seaming, the printing is visible to a consumer at the location of the seam. The printing can comprise a message such as a recycling message (e.g., "PLEASE RECYCLE" or "MICH 10 ¢ VT 5 ¢ REFUND") or other message. The seam of this embodiment can be either a single seam or a double overlap seam. Additionally, the seam can have any of the strengthening techniques described above applied to the seam. A laser weld can also be applied to the seam.

BRIEF DESCRIPTION OF THE DRAWINGS

Representative examples of presently preferred and alternative embodiments are described in conjunction with the appended figures, in which:

FIG. 8B shows multiple welds to increase the strength of the seam. The welds are preferably but not necessarily formed via a laser. The techniques of FIG. 8B are applicable to the other seams shown in the other Figures of this disclosure where a weld (e.g., laser) is used to join a can end to a can body.

DETAILED DESCRIPTION OF THE PREFERRED AND ALTERNATIVE EMBODIMENTS

This invention contemplates several different methods for strengthening a seam or joint between a can end and a can body. The methods are particularly suitable for joints which have a laser weld joining the can end to the can body in the seam, and extending 360 degrees around the seam of the can. The methods are also applicable to seams which have a single fold, a double fold and to double seams as shown in FIG. 1B. However, the strengthening features of this invention could be used in other joints without a laser weld. Before describing the strengthening features in detail, some of the seams with which the strengthening features can be used will be described initially. The preferred embodiments described below generally use less metal for the can end and/or the can body as compared to the prior art double seam of FIG. 1B, by using less metal in the peripheral curl in the can end or in the flange of the can body, and thus present significant savings for the cost of the beverage can.

Figure 1A:
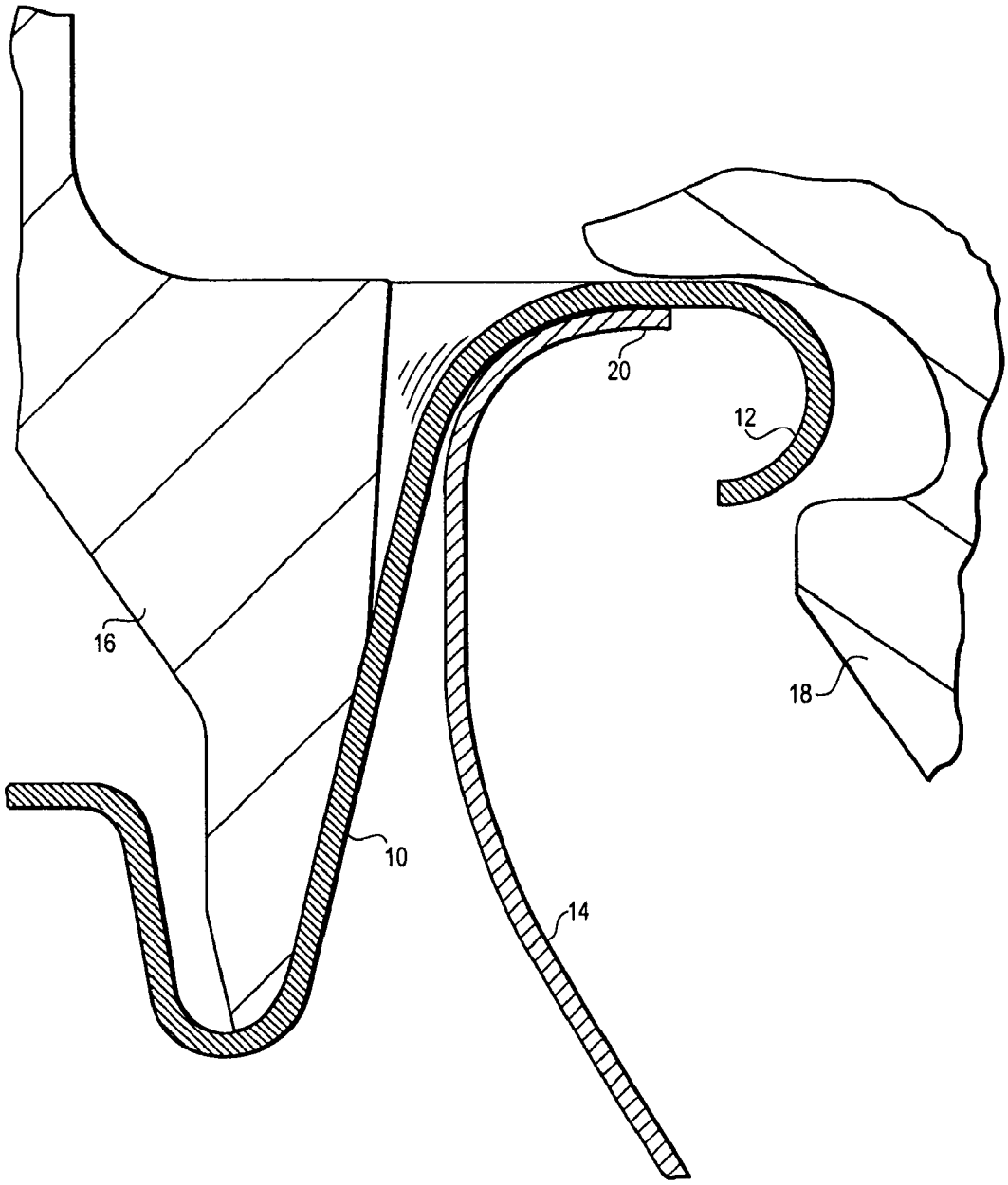
Fig. 1A PRIOR ART
FIGS. 1A and 1B are cross-sections of a can end, can body and seam tooling, showing the flange and curl features of the can body and can end before and after double seaming, in accordance with a known double seam joint.
Figure 2A:
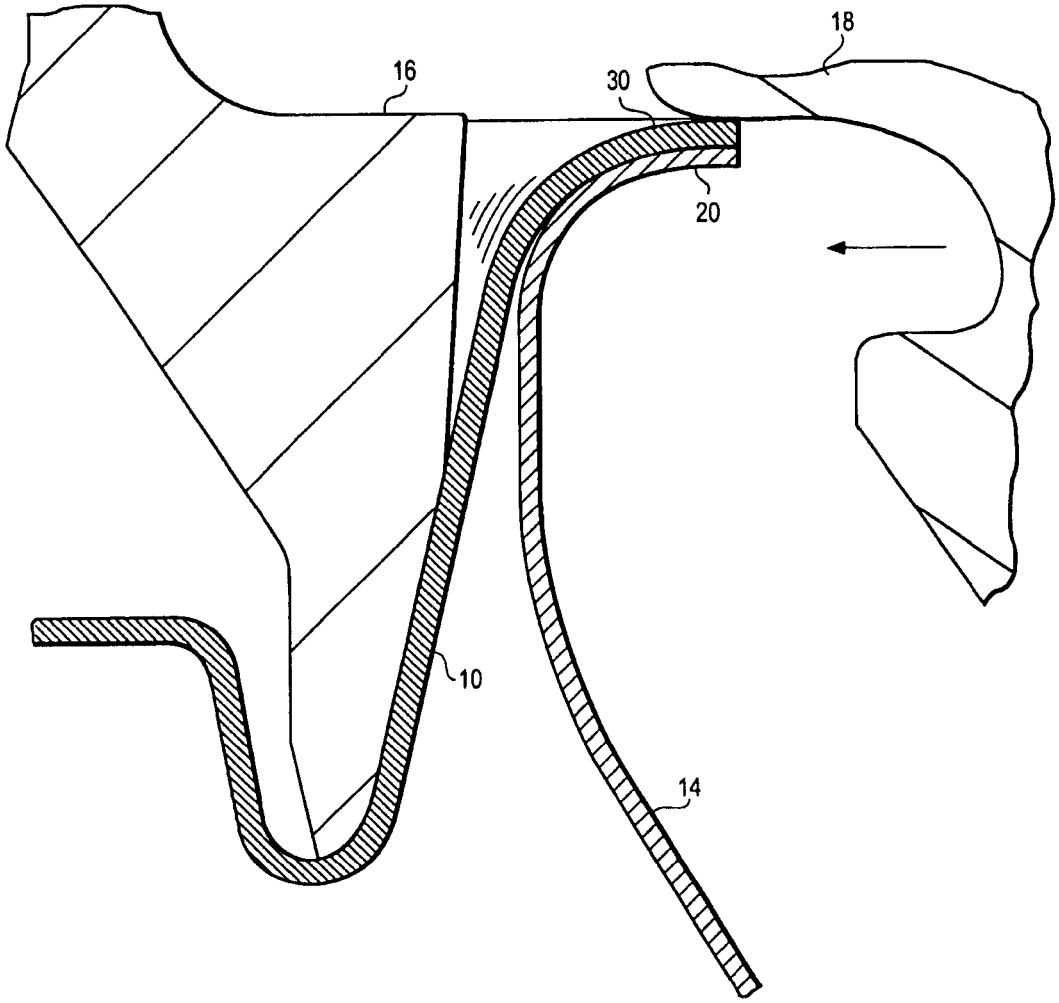
FIGS. 2A and 2B are cross-sections of a can end, can body and seam tooling, showing the flange and curl features of the can body and can end before and after a seaming operation.
Figure 2B:
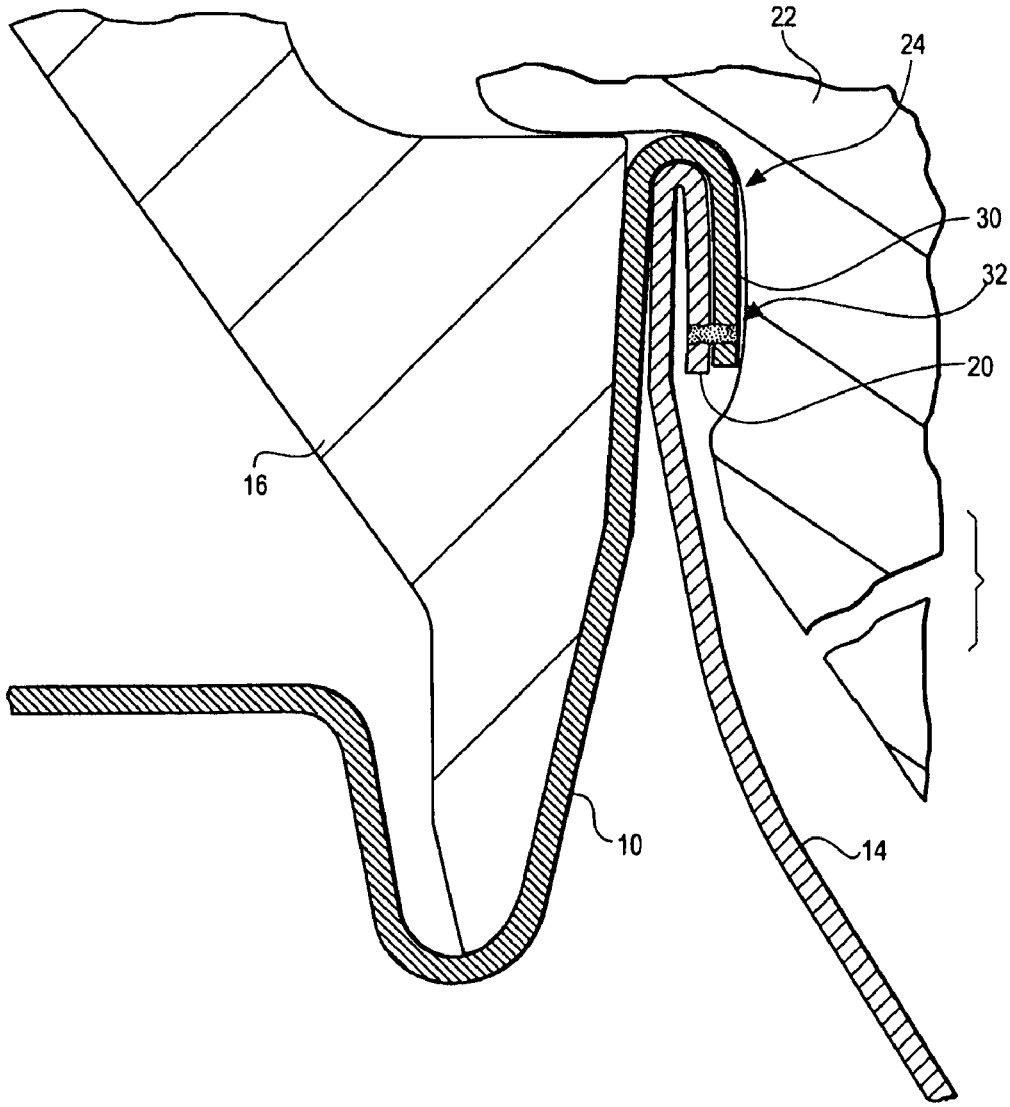

FIGS. 2A and 2B are cross-sections of a can end 10, can body 14 and seam tooling comprising a seaming chuck 16 and a seaming roller 18, showing the flange 20 and curl 30 features of the can body 14 and can end 10, respectively, before and after seaming operations. The can end 10 is placed over the can body 14. The roller 18 of FIG. 2A is moved laterally into engagement with the curl 30 in a first seaming operation, and afterwards the second roller 22 of FIG. 2B is moved laterally into engagement with the curl 30 and flange 20 to press them against the chuck 16 as shown to form a seam 24. The peripheral curl 30 is considerably shortened as compared to the curl 12 in FIG. 1A, thus presenting a savings in metal. In the second seaming operation, the roller of FIG. 2B moves laterally into engagement with the curl 30 and flange 20 and presses them together against the seaming chuck 16 to form a double overlapping (or "double folded") seam 24 as shown in FIG. 2B.

A laser is used to form a weld 32 joining or fusing the curl 30 and the flange 20 together. The laser can form the weld 32 either before or after the seaming operations shown in FIGS. 2A and 2B. For example, prior to engagement of the roller 18 with the curl 30 and flange 20 in FIG. 2A, a laser is moved into position immediately above the curl 30 and a beam of laser energy is applied to the curl 30 to fuse the curl 30 against the flange 20. More preferably, the laser weld 32 is formed after the seam 24 is formed. In particular, the combined can end and can body are moved to a subsequent station where a laser is moved laterally into a position to direct a beam of laser energy to form the laser weld 32 as shown in FIG. 2B, while the can and can end are rapidly rotated about their central (vertical) axis to weld 360 degrees around the seam joint. The techniques described in, for example, Williamson, publication no. WO 02/42196 could be used for the laser seaming. It may also be possible to form the weld using other technique besides laser.

The completed seam 24 as shown in FIG. 2B can be subject to further strengthening operations, including crimping as explained later in conjunction with FIG. 6C, reforming the seam as explained later in conjunction with FIG. 7C, or multiple laser welds as explained in conjunction with FIG. 8B.

Figure 3A:
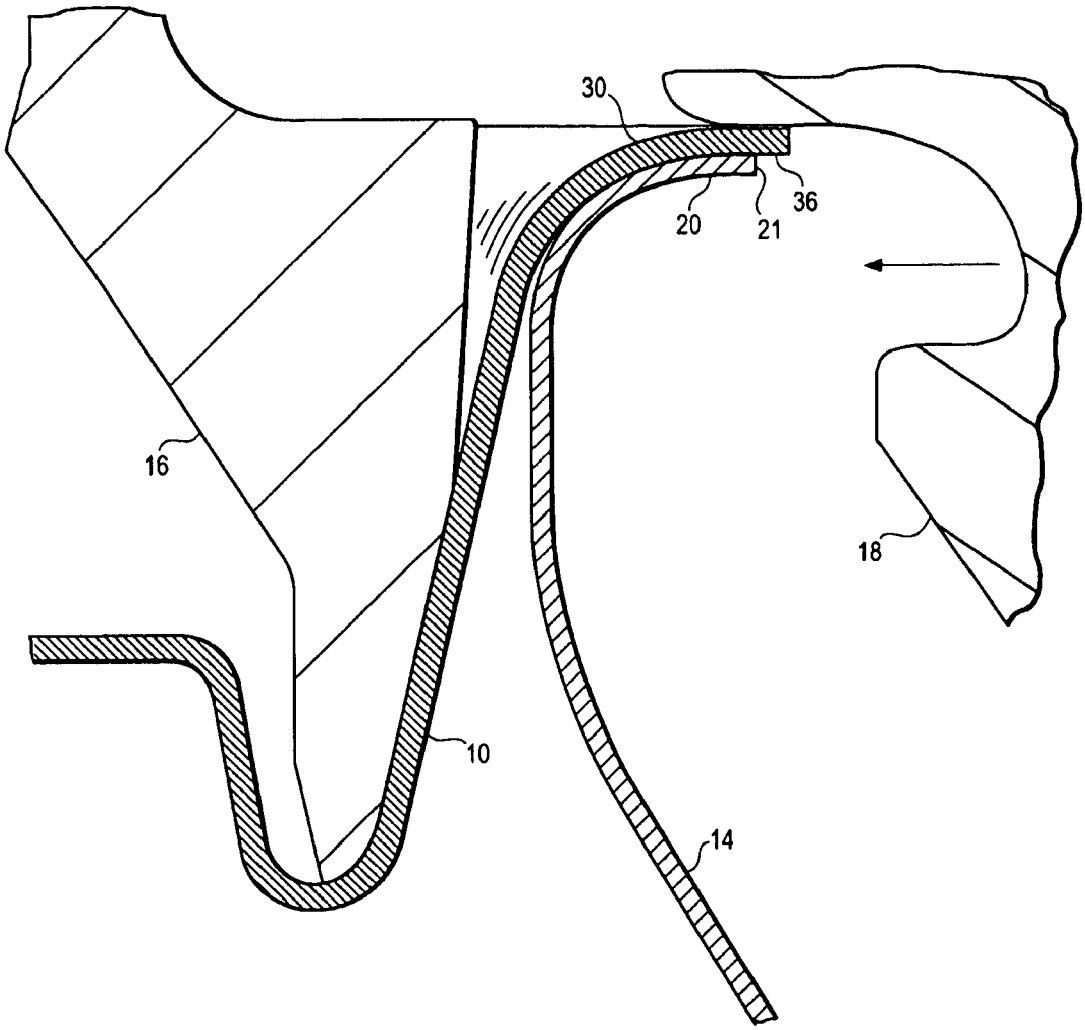
FIGS. 3A and 3B are cross-sections of a can end, can body and seam tooling, showing the flange and curl features of the can body and can end before and after a seaming operation.
Figure 3B:
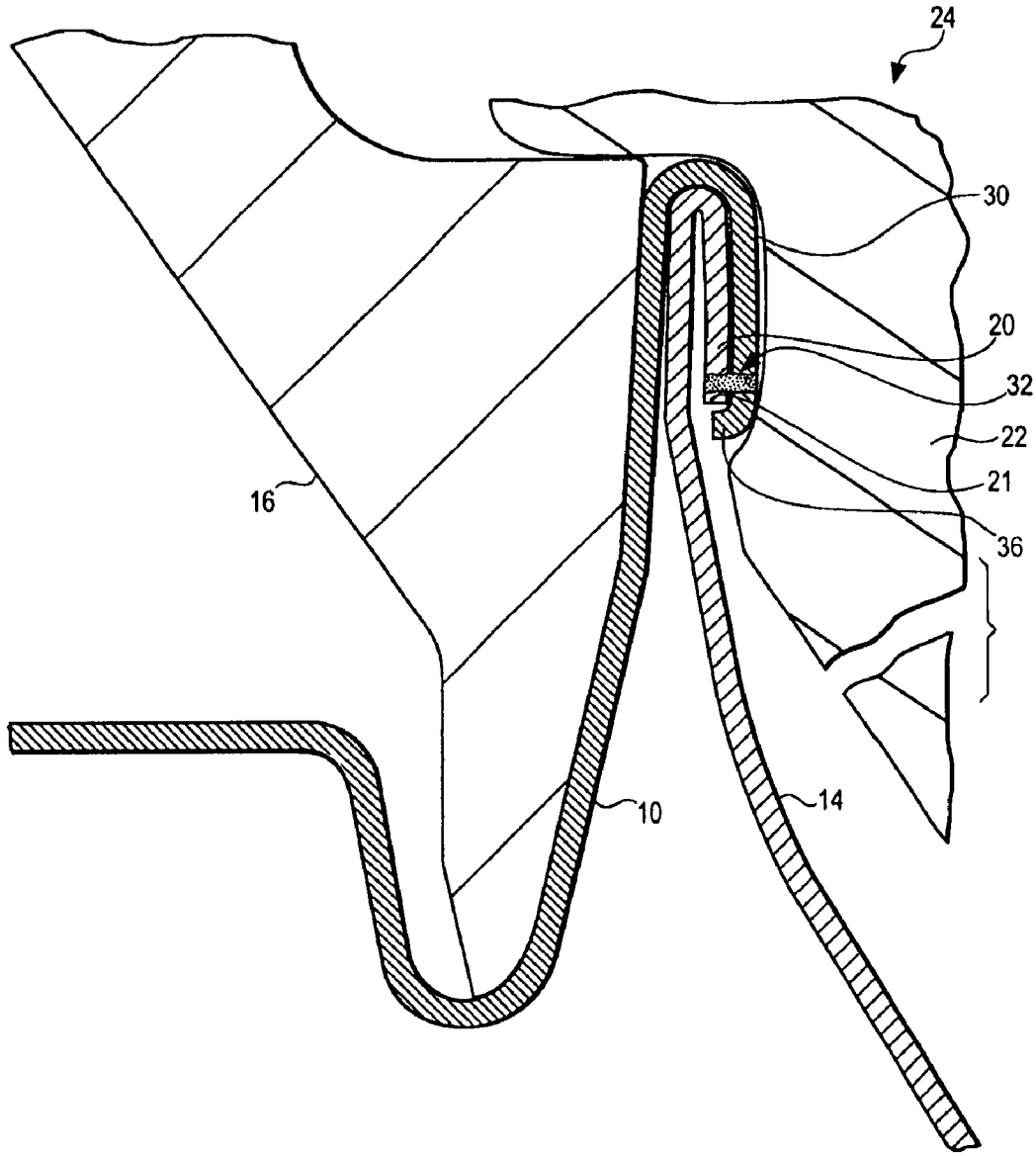

FIGS. 3A and 3B are cross-sections of a can end 10, can body 14 and seam tooling comprising seaming chuck 16 and roller 18, showing the flange 20 and curl 30 features of a can body 14 and can end 10 before and after a seaming operation in accordance with another embodiment. The curl 30 includes an extension portion 36, which extends past the edge 21 of the flange 20. The can end 10 is placed over the can body 14. In a first operation (FIG. 3A), the seaming roller 18 moves laterally into engagement with the curl 30 to partially fold the curl over the flange 20. In a second operation (FIG. 3B), a second roller 22 moves laterally into engagement with the partially folded curl to compress the curl 30 and flange 20 against the chuck 16 to form a double overlapping seam 24 as shown in FIG. 3B. The roller 22 is formed such that when the seam 24 is formed the terminal end of the peripheral curl 30 is substantially folded under the flange 20 to form a smooth seam, and in particular the extension 36 bends and wraps the sharp edge 21 of the flange 20 as shown in FIG. 3B. The smooth surface formed by the curl 30 (including the extreme peripheral portion under the edge 21) prevents any sharp edges from coming into contact with the lips or tongue if the contents are consumed directly from the container.

As shown in FIG. 3B, a laser weld 32 is provided to fuse the flange 20 and curl 30 together. This is preferably performed after the seam 24 is formed, e.g., in a downstream processing location after the completion of the seam 24 as shown.

The completed seam 24 as shown in FIG. 3B can be subject to further strengthening operations, including crimping as explained later in conjunction with FIG. 6C, reforming the seam as explained later in conjunction with FIG. 7C, or multiple laser welds as explained in conjunction with FIG. 8B.

Figure 4A:
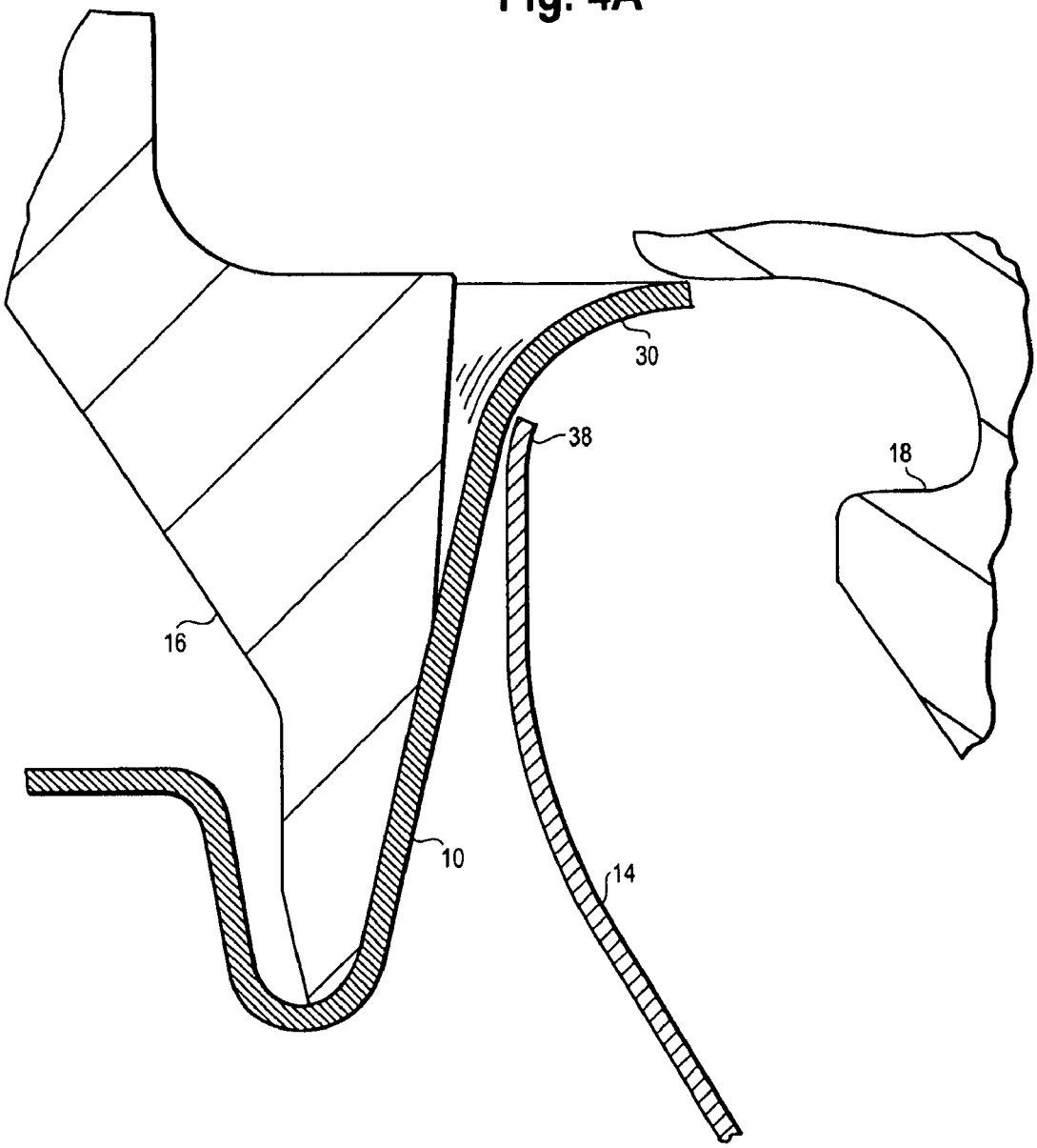
FIGS. 4A and 4B are cross-sections of a can end, can body and seam tooling, showing the flange and curl features of the can body and can end before and after a seaming operation.
Figure 4B:
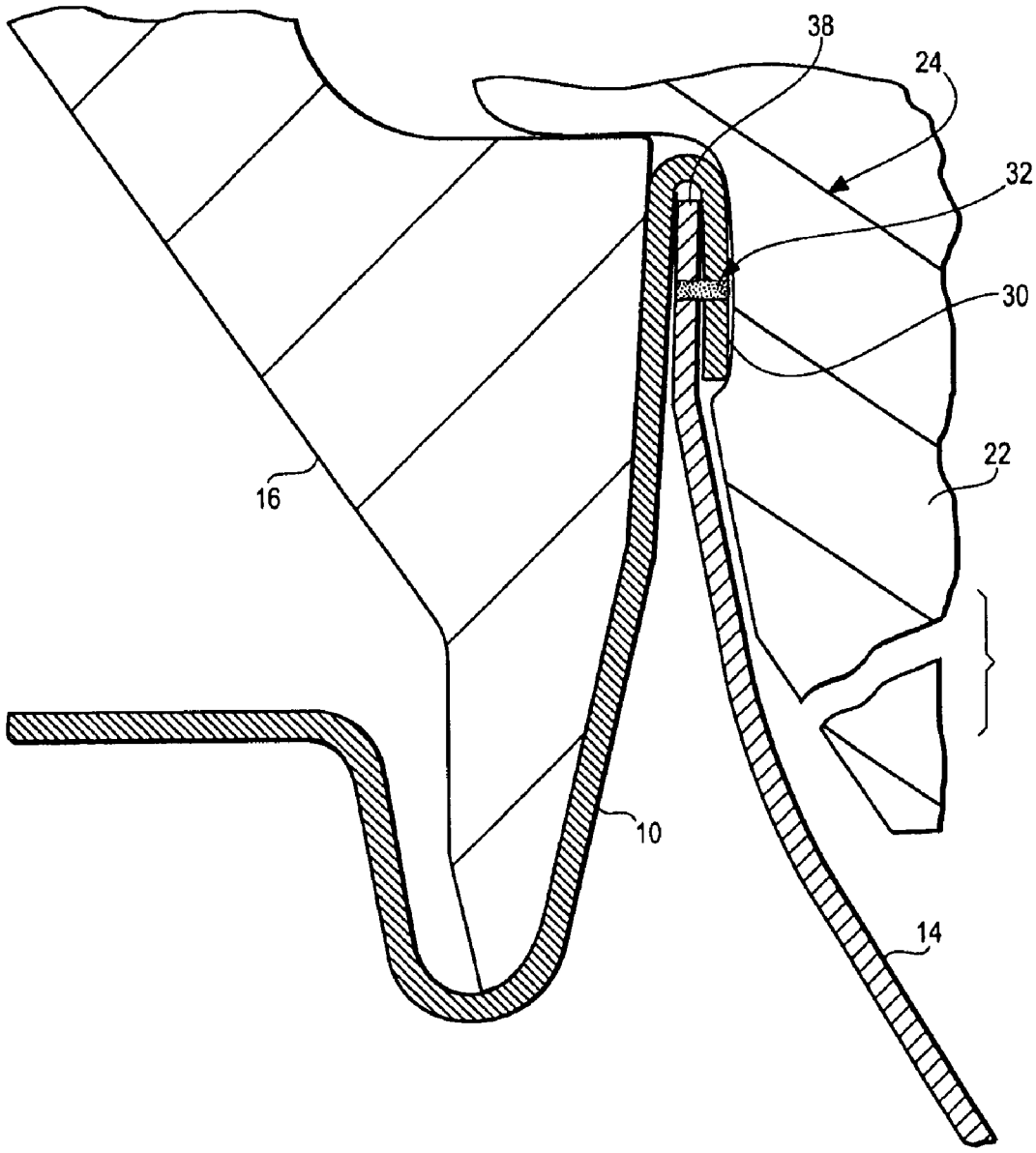

FIGS. 4A and 4B are cross-sections of a can end 10, can body 14 and seam tooling comprising chuck 16 and seaming rollers 18 and 22, showing a peripheral edge 38 and curl 30 features of the can body 14 and can end 10, respectively, before and after seaming operations in accordance with another embodiment. In a first operation (FIG. 4A), the seaming roller 18 moves laterally into engagement with the curl 30 and partially folds the curl 30 over the peripheral edge 38 of the can body. In a second operation (FIG. 4B), the second seaming roller 22 moves laterally into engagement with the curl 30 and presses the curl 30 and peripheral portion 38 against the seaming chuck 16 to complete the forming of a single overlapping seam 24.

As shown in FIG. 4B, a laser weld 32 is provided to fuse the can body 14 and curl 30 together. This is preferably performed after the seam 24 is formed, e.g., in a downstream processing location after the completion of the seam 24 as shown.

The completed seam 24 as shown in FIG. 4B can be subject to further strengthening operations, including crimping as explained later in conjunction with FIG. 6C, reforming the seam as explained later in conjunction with FIG. 7C, or multiple laser welds as explained in conjunction with FIG. 8B.

Figure 1B:
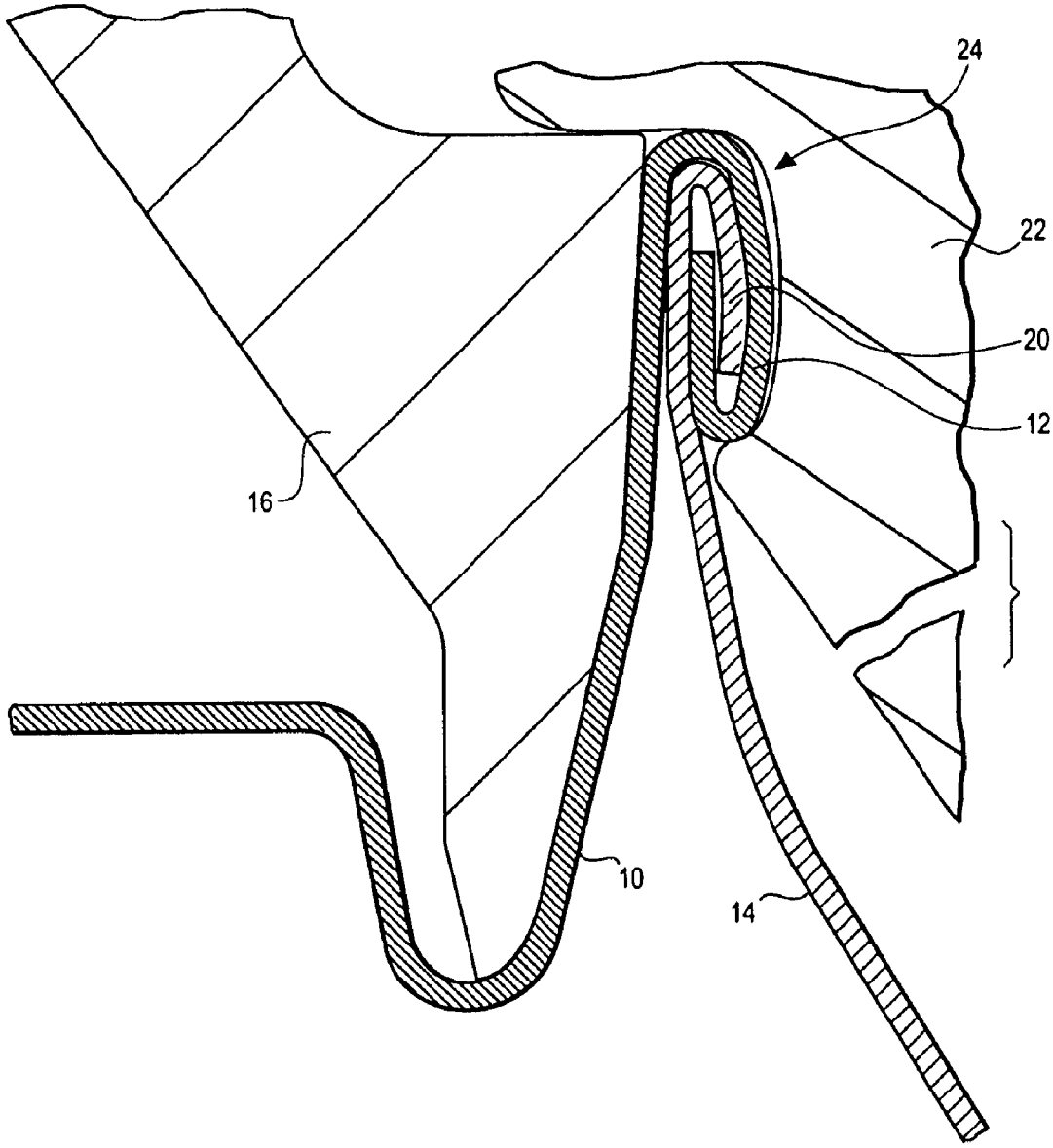
Fig. 1B PRIOR ART

The embodiment of FIG. 4A and 4B saves metal in the can body 14 as well as in the can end as compared to a prior art double seam, as can be appreciated by comparison of FIG. 4A with FIG. 1A.

Figure 5A:
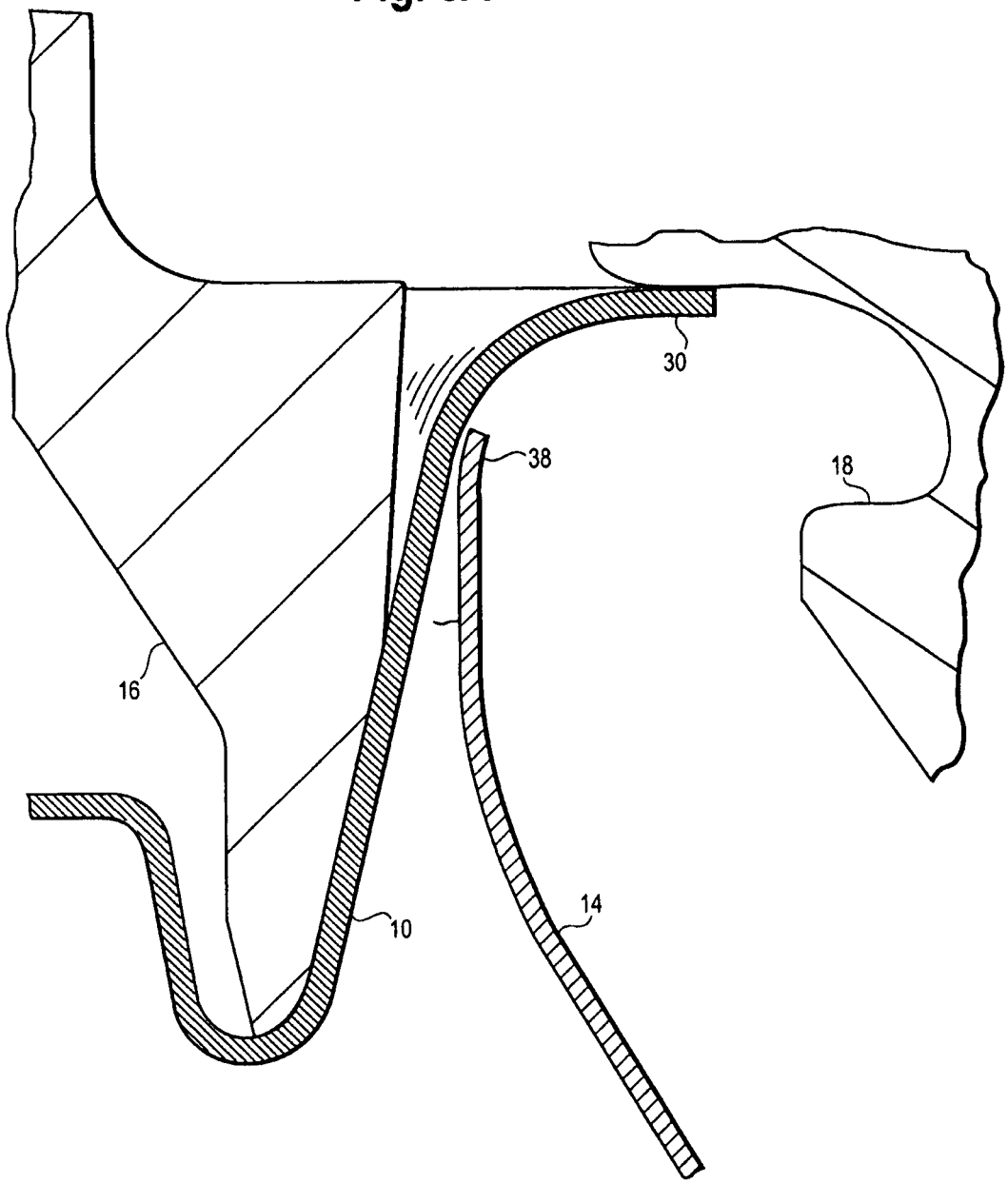
FIGS. 5A and 5B are cross-sections of a can end, can body and seam tooling, showing the flange and curl features of the can body and can end before and after a seaming operation.
Figure 5B:
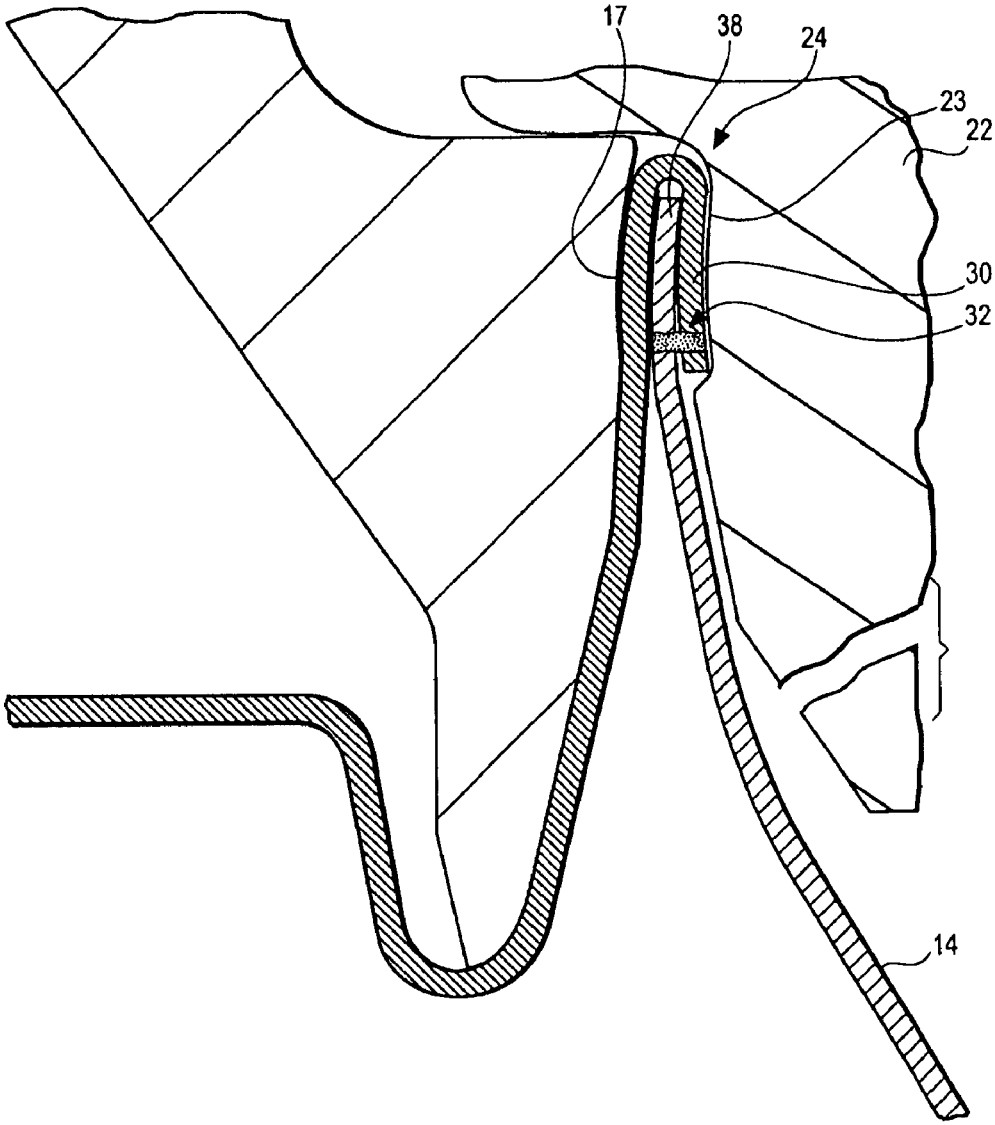

FIGS. 5A and 5B are cross-sections of a can end 10, can body 14 and seam tooling comprising seaming chuck 16 and seaming rollers 18 and 22, showing the upper peripheral portion 38 and curl 30 features of the can body 14 and can end 10, respectively, before and after a seaming operation. In the embodiment of FIG. 5A and 5B, the seaming chuck includes a curved surface 17 and the seaming roller 22 includes a curved surface 23, which produces a curve in the seam 24 as shown in FIG. 5B. The formation of the seam is otherwise as described in conjunction with FIGS. 4A and 4B. The curve in the seam increases the hoop strength of the seam.

As shown in FIG. 5B, a laser weld 32 is provided to fuse the can body 14 and curl 30 together. This welding operation is preferably performed after the seam 24 is formed, e.g., by a laser in a downstream laser station after the completion of the seam 24 as shown.

The completed seam 24 as shown in FIG. 5B can be subject to further strengthening operations, including crimping as explained later in conjunction with FIG. 6C, reforming the seam as explained later in conjunction with FIG. 7C, or multiple laser welds as explained in conjunction with FIG. 8B.

The embodiment of FIG. 5A and 5B saves metal in the can body 14 as well as in the can end as compared to a prior art double seam, as can be appreciated by comparison of FIG. 5A with FIG. 1A.

Figure 6A:
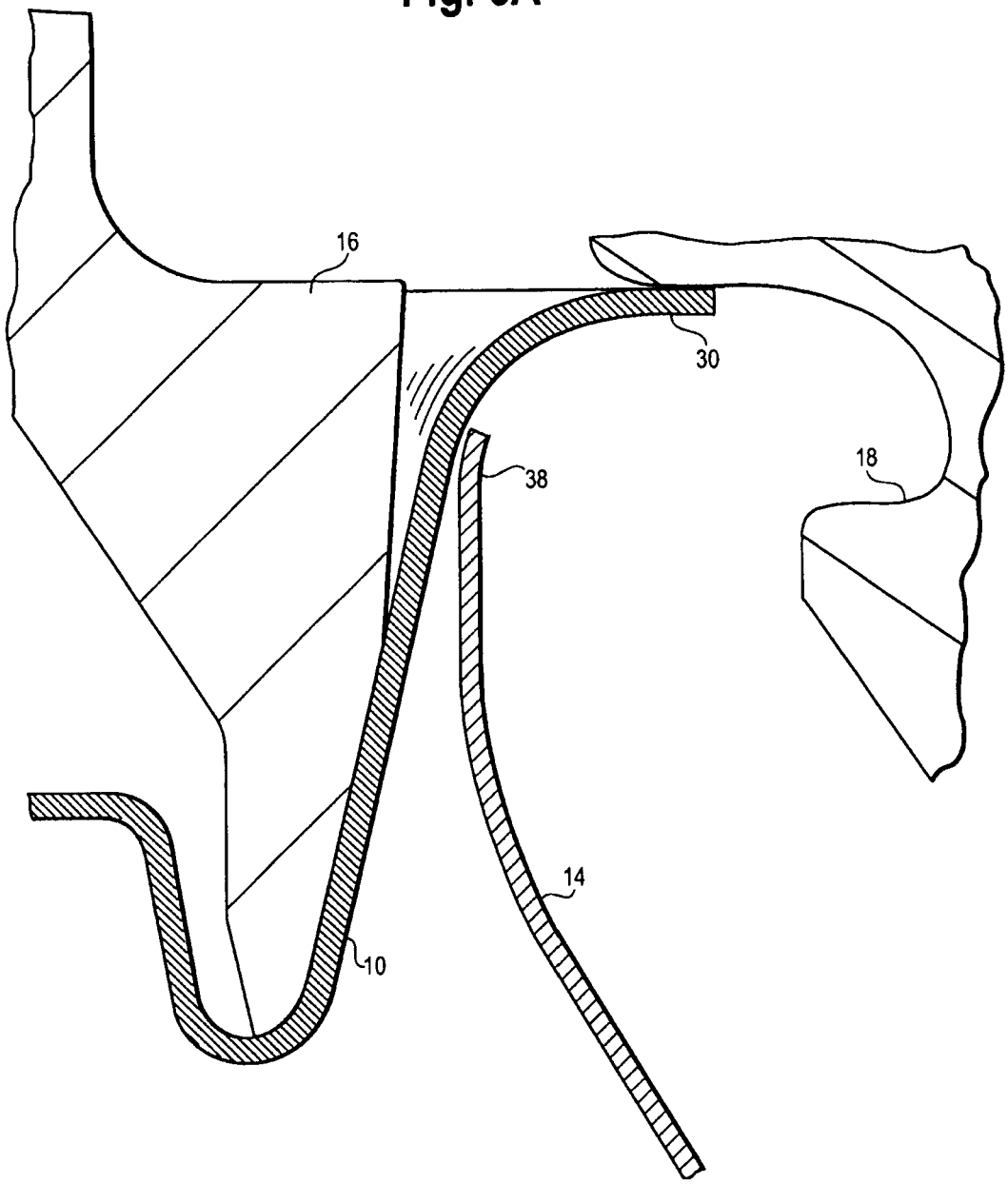
FIGS. 6A and 6B are cross-sections of a can end, can body and seam tooling, showing the flange and curl features of the can body and can end before and after a seaming operation.
Figure 6B:
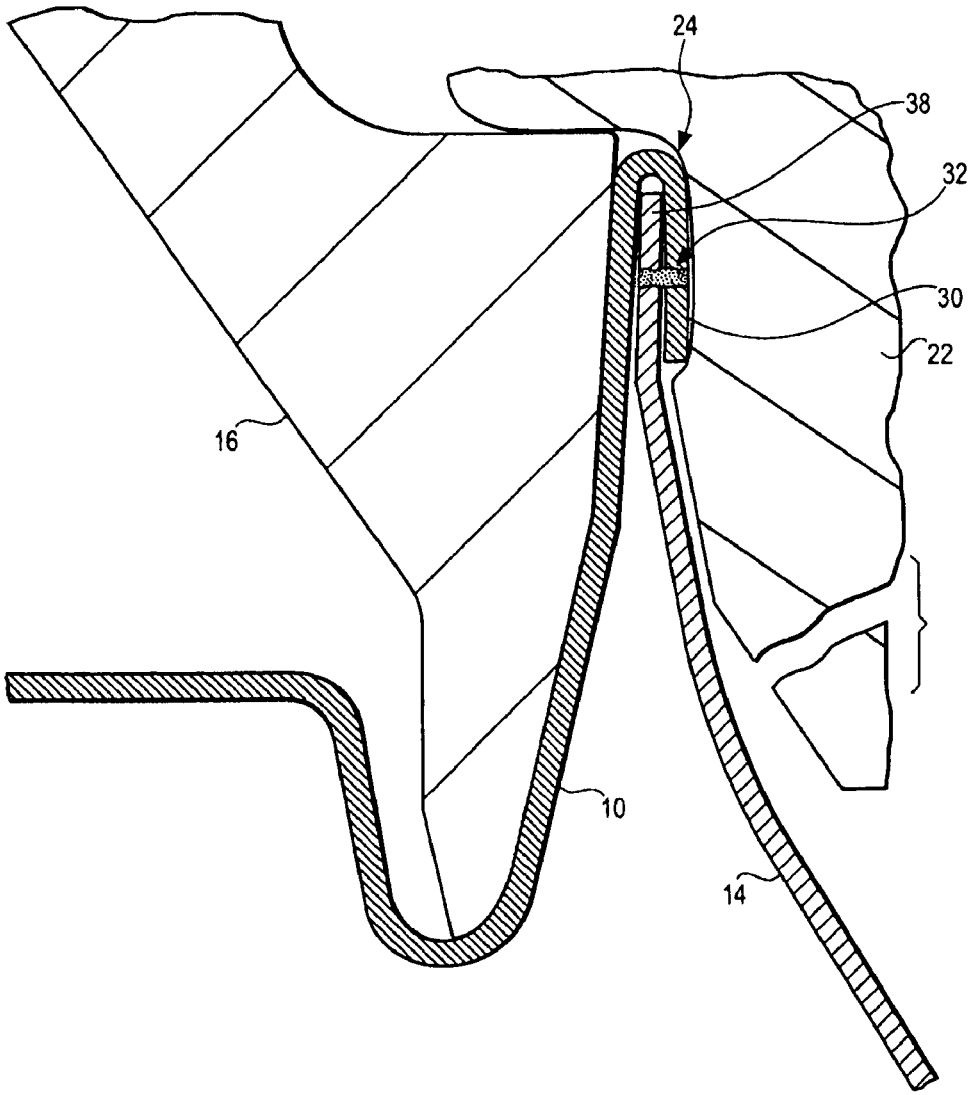

FIGS. 6A and 6B are cross-sections of a can end 10, can body 14 and seam tooling comprising seaming chuck 16 and rollers 18 and 22, showing the peripheral portion 38 and curl portion 30 of the can body 14 and can end 10, respectively, before and after a seaming operation in accordance with another embodiment. In a first operation (FIG. 6A), the seaming roller 18 moves laterally into engagement with the curl 30 to partially fold the curl 30 over the upper edge 38 of the can body 14. In a second operation (FIG. 6B), the second seaming roller 22 moves laterally into engagement with the peripheral curl 30 and presses the curl 30 and peripheral portion 38 together against the chuck 16 to form a single overlap seam joint 24 as shown.

A laser is then directed to the seam to form a weld 32 fusing the curl 30 to the upper edge of the can body 14 as shown. This welding operation is preferably performed after the seam 24 is formed, e.g., by a laser in a downstream laser station after the completion of the seam 24 as shown.

Figure 6C:
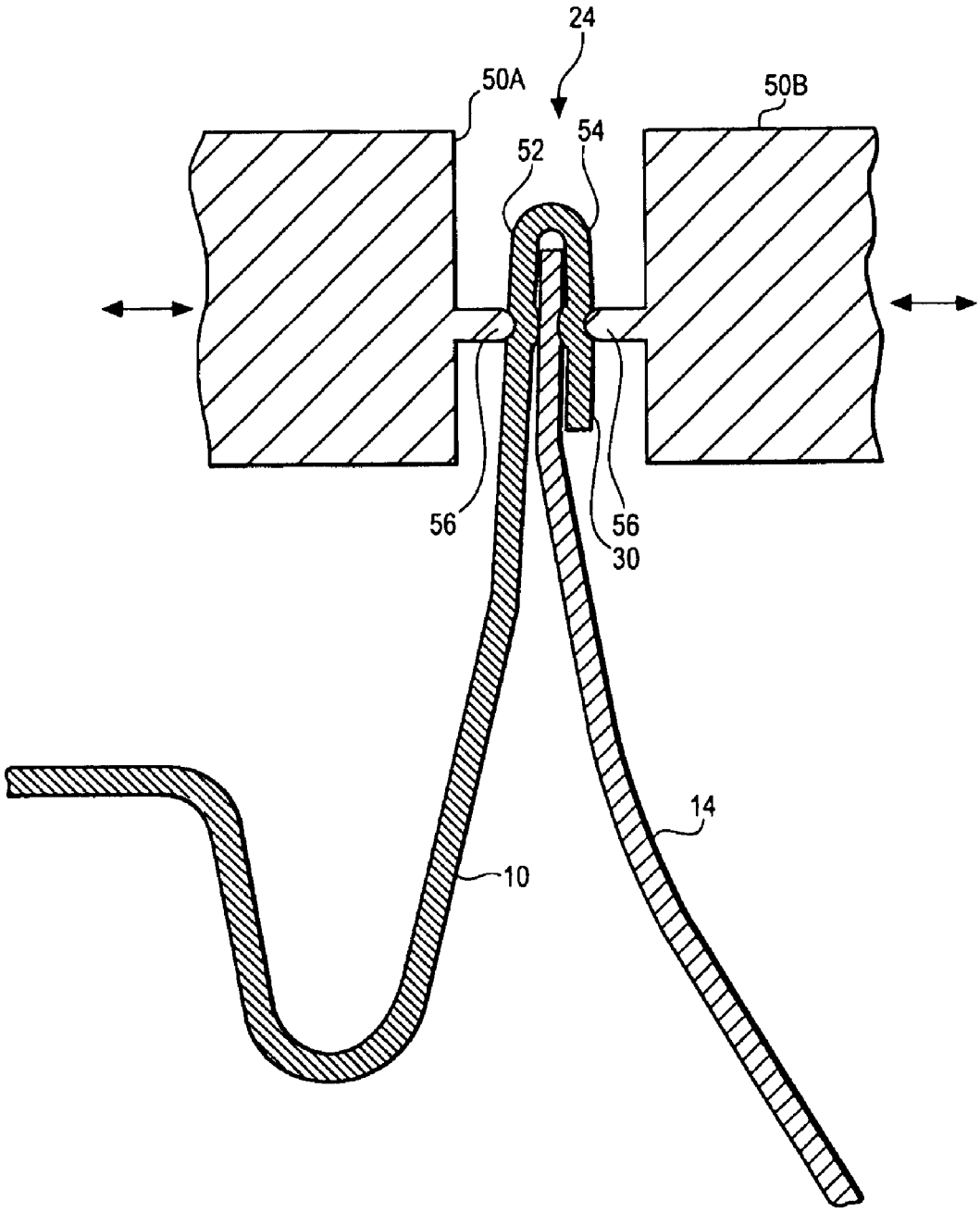
FIG. 6C shows a crimping operation performed on the seam of FIG. 6B. The crimping operation of FIG. 6C is applicable to any of the seams shown in the other Figures of this disclosure.

FIG. 6C shows a crimping operation performed on the seam of FIG. 6B. Preferably, the crimping operation is performed before the laser weld of FIG. 6B is made on the seam 24. The crimping operation shown consists of moving a pair of crimping rollers 50A and 50B laterally into engagement with the inner 52 and outer 54 portions of the seam 24. The crimping rollers 50 have a raised portion 56 positioned at the same elevation so that the portions 56 form a crimp in the seam 24 as shown. The crimping rollers roll freely as the can and can body are rotated rapidly about their central axis so as to form a crimp extending 360 degrees around the entire rim of the can. It may be possible to use one crimping roller on one side of the seam and a roller with a bearing surface on the opposite side of the seam and crimp only one side of the seam. The crimping operation of FIG. 6C is applicable to any of the seams shown in the other Figures of this disclosure. The presence of the crimp increases the hoop strength of the seam joint 24 and makes the can more able to withstand higher internal pressures inside the can. After crimping as shown in FIG. 6C, the can is sent to a laser station where a laser weld is applied to the seam 24. It may be possible to perform the crimping before the laser weld is applied to the seam, but that may not be as desirable as crimping after the laser has been applied if the crimping affects the strength or integrity of the weld.

Figure 7A:
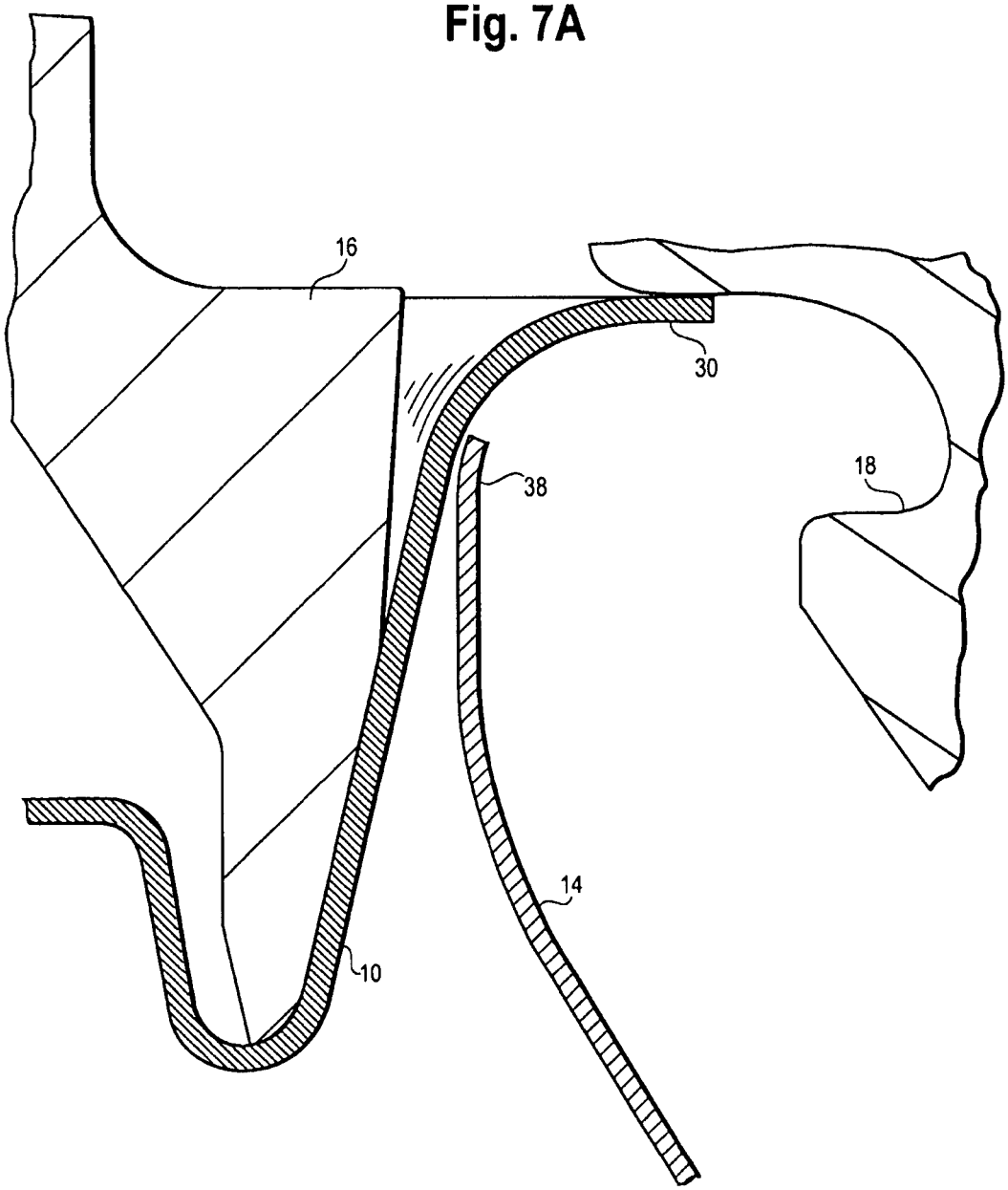
FIGS. 7A and 7B are cross-sections of a can end, can body and seam tooling, showing the flange and curl features of the can body and can end before and after a seaming operation in accordance with another embodiment.
Figure 7B:
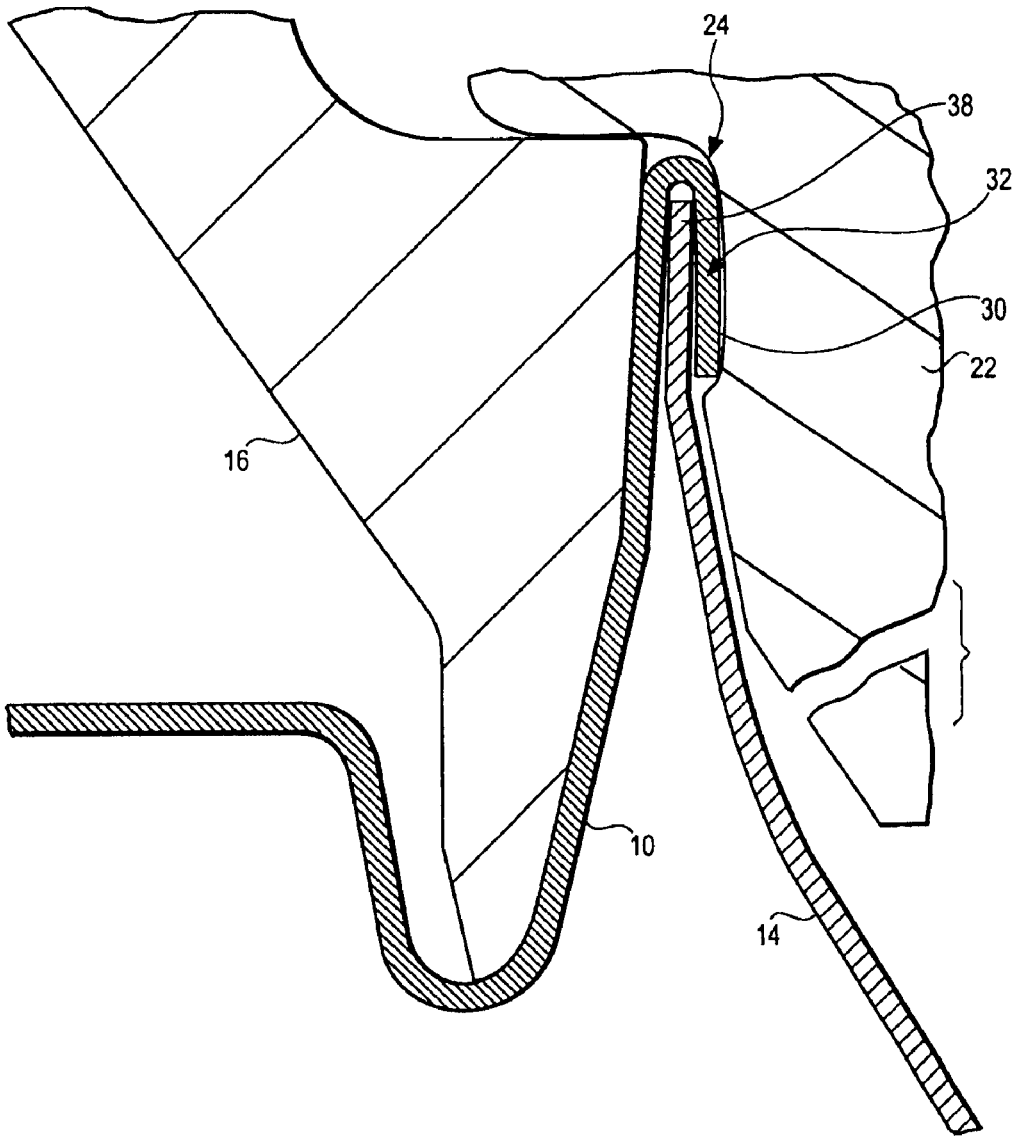

FIGS. 7A and 7B are cross-sections of a can end 10, can body 14 and seam tooling comprising seaming chuck 16 and rollers 18 and 22, showing the peripheral portion 38 and curl portion 30 of the can body 14 and can end 10, respectively, before and after a seaming operation in accordance with another embodiment. In a first operation (FIG. 7A), the seaming roller 18 moves laterally into engagement with the curl 30 to partially fold the curl 30 over the upper edge 38 of the can body 14. In a second operation (FIG. 7B), the second seaming roller 22 moves laterally into engagement with the peripheral curl 30 and presses the curl 30 and edge 38 together against the chuck 16 to form a single overlap seam joint 24 as shown.

The seam 24 of FIG. 7B can be further strengthened by performing a reforming operation on the seam. FIG. 7C shows a reforming operation performed on the seam of FIG. 7B to further strengthen the seam. In FIG. 7C, a first roller 70 and a second roller 72 are moved laterally into engagement with the seam 24 as shown. The first roller 70 is preferably mounted on an eccentric so as to be moveable into and out of engagement with the seam 24. The roller 70 has an anvil portion 74 which is inclined at an angle $\alpha$ relative to a line 76 parallel to the central axis of the can end and can body. The angle $\alpha$ can vary somewhat, and representative embodiments have a value of between about 5 and about 15 degrees. The roller 72 has a bearing surface 78 that bears against the seam and presses the seam against the anvil portion 74 to reform the seam during this operation. The resulting seam 24 has increased hoop strength and can withstand greater pressures in the can.

A laser is then directed to the seam to form a weld 32 fusing the curl 30 to the upper edge 38 of the can body 14 as shown. This welding operation is preferably performed after the seam 24 is formed and after reforming, e.g., by a laser in a downstream laser station after the completion of the seam 24 and reforming. The laser welding could also be performed after seaming and prior to reforming, or prior to the seaming operations of FIGS. 7A and 7B.

Figure 7C:
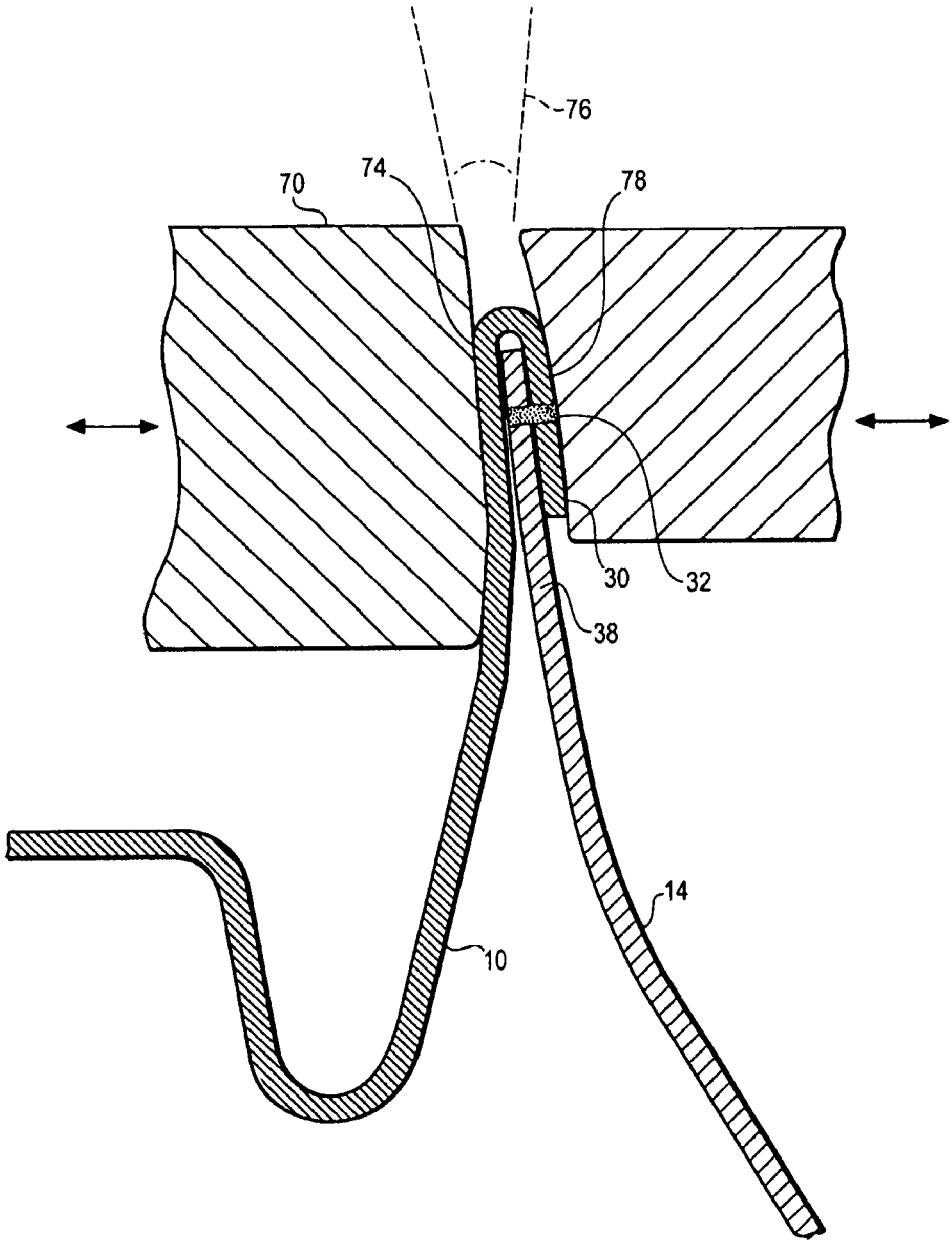
FIG. 7C shows a further seaming operation performed on the seam of FIG. 7B to further strengthen the seam. The seaming operation of FIG. 7C is applicable to any of the seams shown in the other Figures of this disclosure.

The strengthening operation of FIG. 7C can be in addition to the crimping operation of FIG. 6C.

Figure 8A:
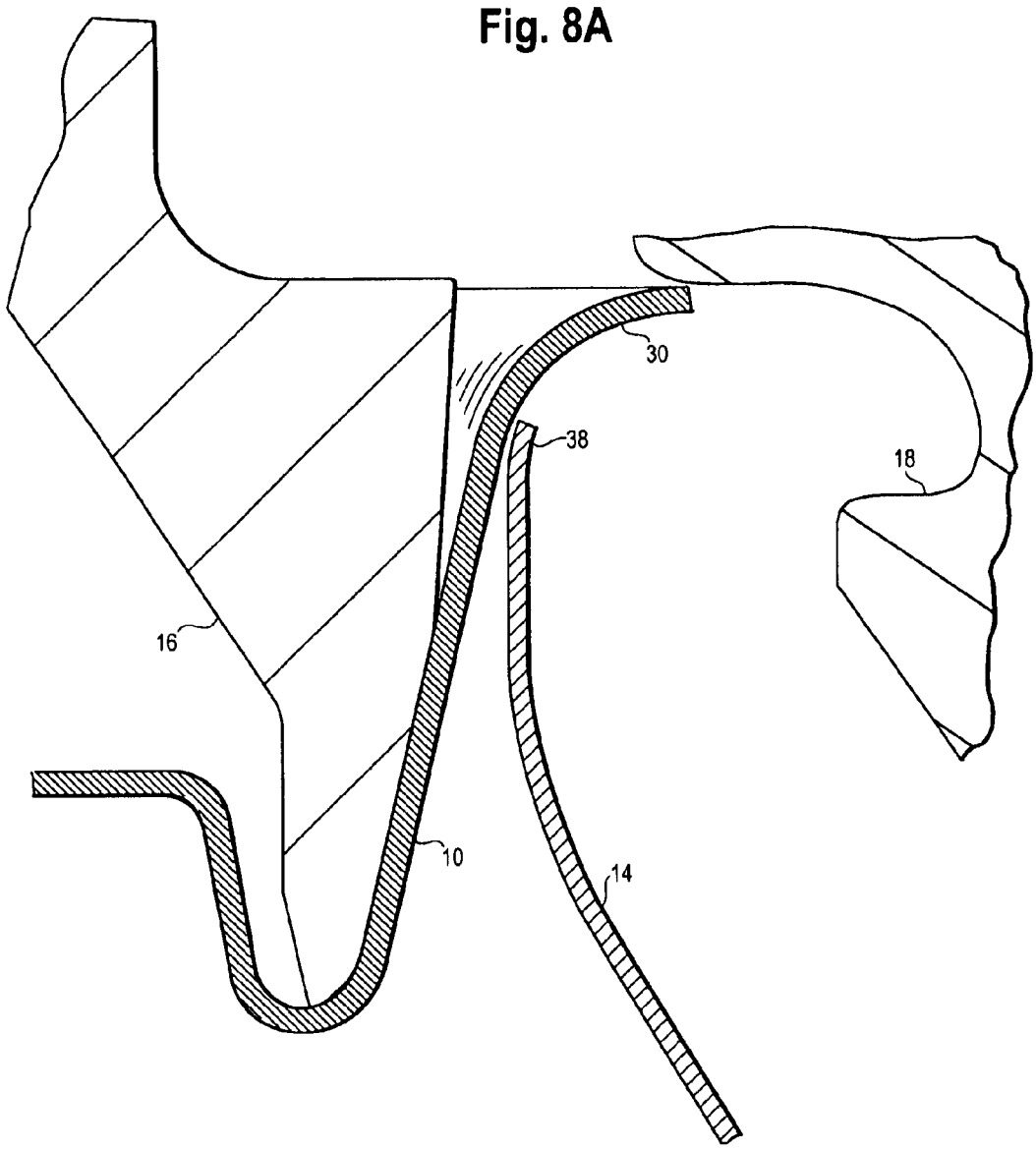
FIGS. 8A and 8B are cross-sections of a can end, can body and seam tooling, showing the flange and curl features of the can body and can end before and after a seaming operation in accordance with another embodiment.
Figure 8B:
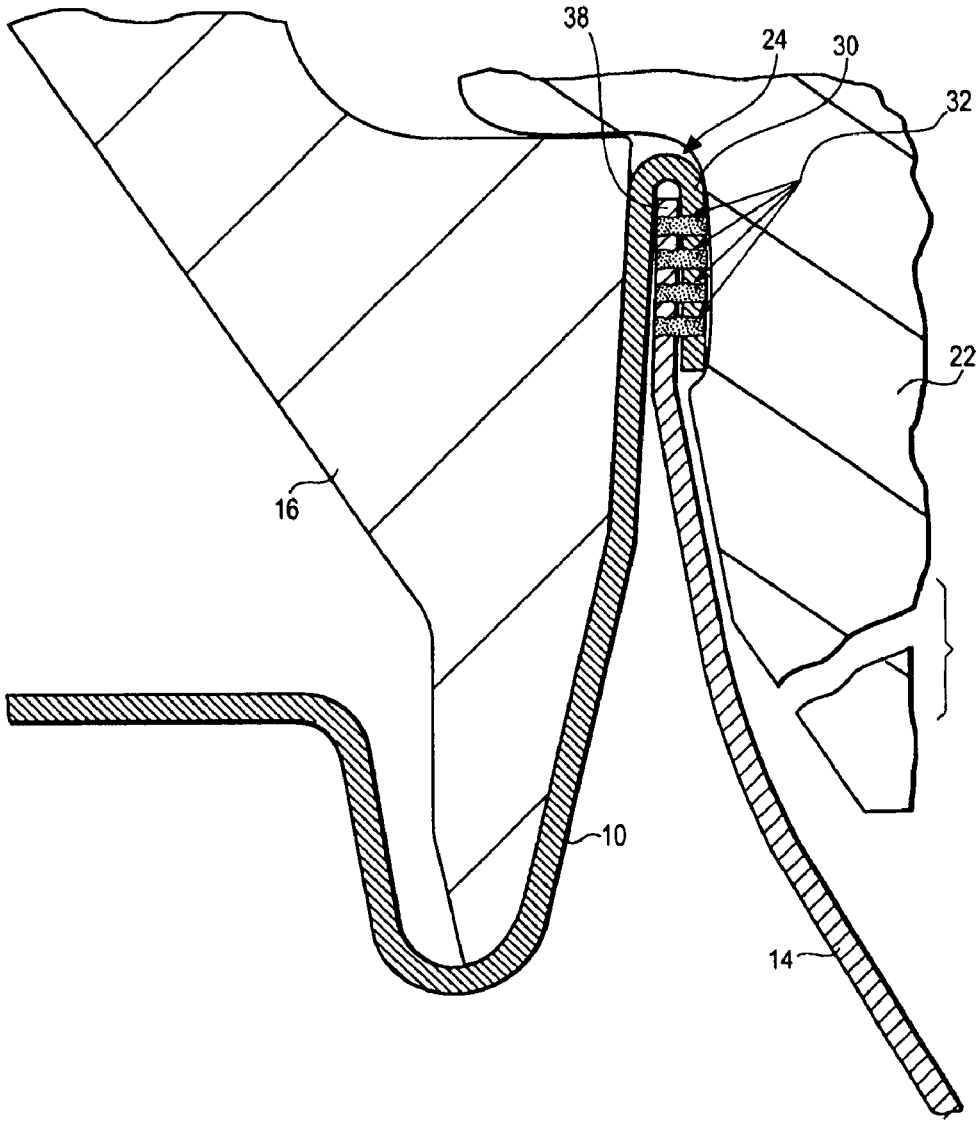

FIGS. 8A and 8B are cross-sections of a can end 10, can body 14 and seam tooling comprising seaming chuck 16 and rollers 18 and 22, showing the peripheral portion 38 and curl portion 30 of the can body 14 and can end 10, respectively, before and after a seaming operation in accordance with another embodiment. In a first operation (FIG. 8A), the seaming roller 18 moves laterally into engagement with the curl 30 to partially fold the curl 30 over the upper edge 38 of the can body 14. In a second operation (FIG. 8B), the second seaming roller 22 moves laterally into engagement with the peripheral curl 30 and presses the curl 30 and edge 38 together against the chuck 16 to form a single overlap seam joint 24 as shown.

FIG. 8B showing multiple laser welds 32 extending 360 degrees around the seam joint 24 are applied in a spaced apart fashion in the region of the seam 24, in order to increase the strength of the seam. Four such welds are shown in the illustrated embodiment. The welds 32 are preferably formed after the completion of the seaming operation of FIG. 8B. For example, after the seam 24 is formed, the can is sent to a downstream laser station where a single laser is moved to four positions and forms four welds 32, 360 degrees around the seam area as the can is rapidly rotated about its central axis.

The techniques of FIG. 8B are applicable to the other seams shown in the other Figures of this disclosure in which a laser weld is used to join a can end 10 to a can body 14.

The resulting seam as shown in FIG. 8B could also be reformed as shown in FIG. 7C, or crimped as shown in FIG. 6C.

Figure 9A:
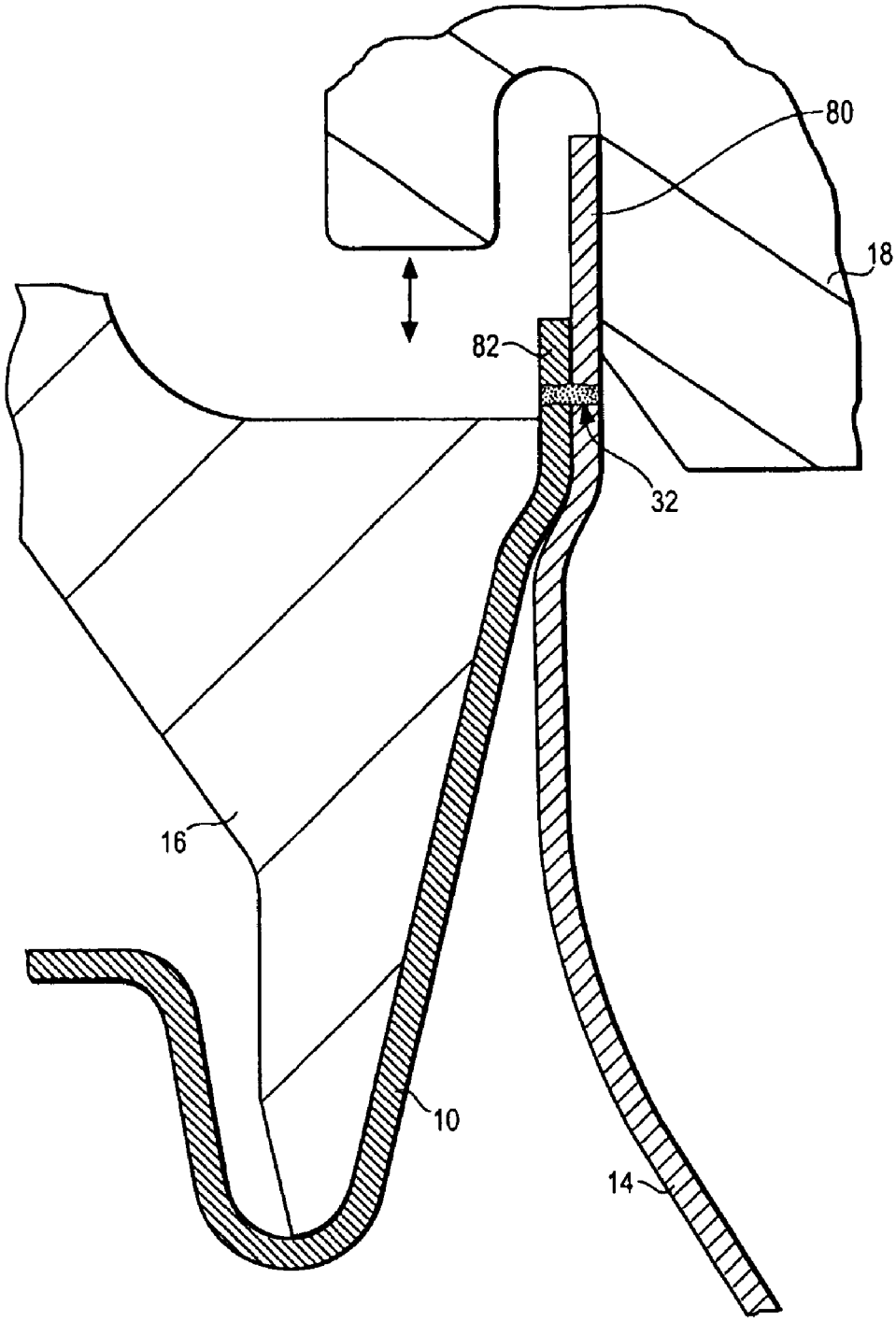
FIGS. 9A and 9B are cross-sections of a can end, can body and seam tooling, showing the flange and curl features of the can body and can end before and after a seaming operation in accordance with another embodiment. The seam of FIG. 9B is particularly useful for providing space for printing in the can in the region of the seam.
Figure 9B:
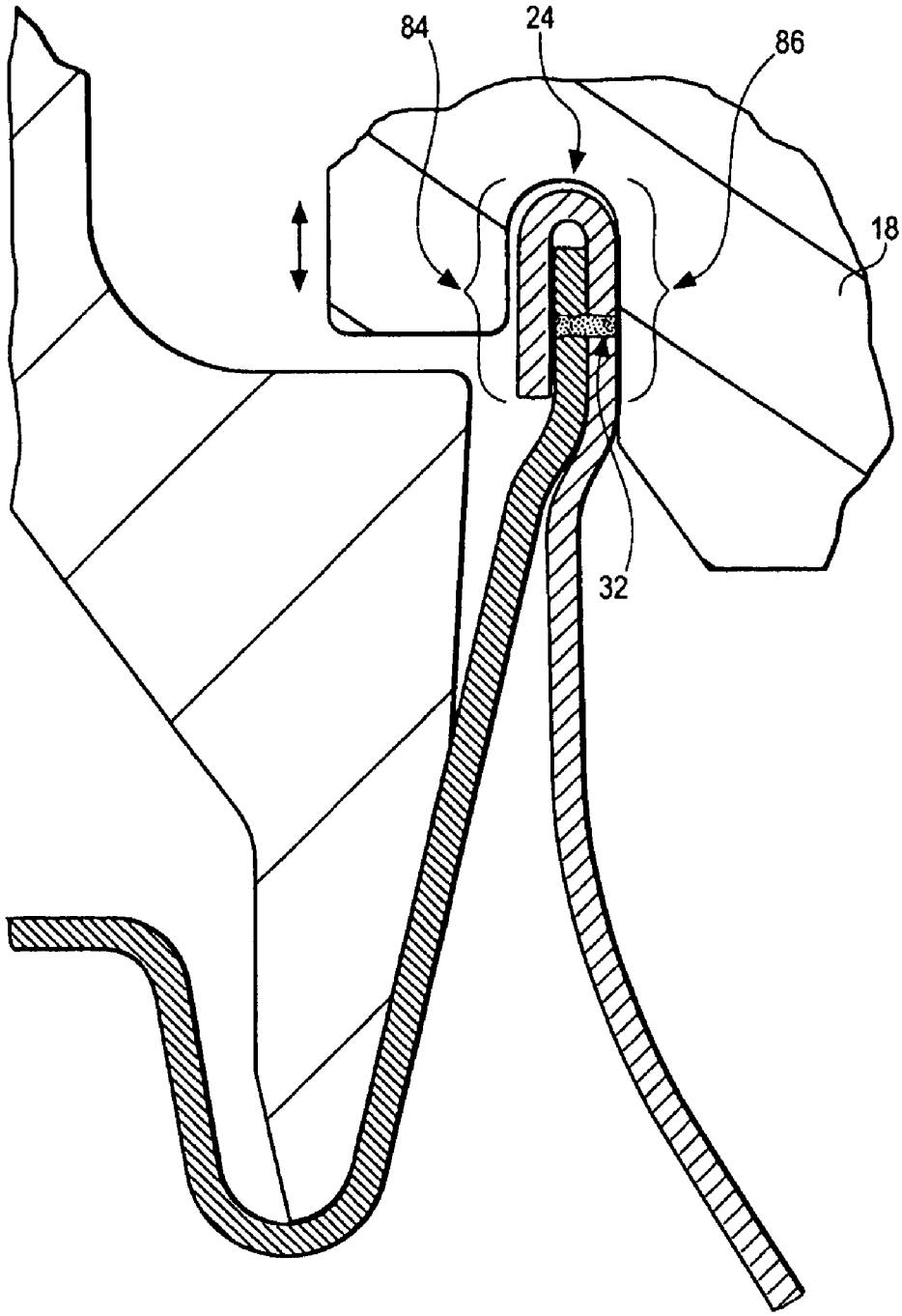

FIGS. 9A and 9B are cross-sections of a can end 10, can body 14 and seam tooling comprising seaming chuck 16 and a roller 18, showing a peripheral extension portion 80 of a can body 14 and a peripheral edge 82 of a can end 10, respectively, before and after a seaming operation in accordance with another embodiment. In a first operation (FIG. 9A), the seaming roller 18 moves vertically down into engagement with the can body extension 80 to partially fold the extension 80 over the edge 82 of the can end. In a second operation (FIG. 9B), the roller 18 continues to move down to the position as shown to form a single overlap seam joint 24 as shown. The flange extension 80 is folded inwards over the edge 82 of the can end 10, that is, towards the center of the can end. It may be possible to perform a single rolling operation in this embodiment.

Either before or after the performance of the seaming operation shown in FIGS. 9A and 9B, a laser is directed to the area in which the edge 82 and extension 80 are in contact, to form a weld 32 fusing the can end to the can body. FIG. 9A shows the weld 32 already in place prior to the seaming operation. Multiple welds as shown in FIG. 8B could be used.

In one possible embodiment, the welding operation is performed after the seam 24 of FIG. 9B is formed, e.g., by a laser in a downstream laser station after the completion of the seam 24.

The embodiment of FIG. 9B is particularly useful for providing space for printing in the can in the region of the seam. In particular, the outer surface of the extension region 80 of the can body 14 can be provided with messages (such as recycling messages, promotional messages, other) and when the seam of FIG. 9B is formed the messages are displayed in the regions 84 and/or 86. Since printing is already provided on the external surface of a can body, there is no additional cost for providing printing in this extension region 80. Additionally, current practice in the art is to provide recycling messages ("PLEASE RECYCLE", "MI 5 ¢ VT 5 ¢ REFUND", etc.) on the center panel of the can end by incising, scoring or other technique. These incising or scoring marks tend to weaken the center panel, thus having the potential deleterious effect on can end buckle strength. Such marking is not necessary since the same recycling or other messages are provided via printing appearing in the region 84 inside the seam 24. Thus, when the consumer inspects the top of the can at an oblique angle, they will see the message in the region 84, particularly if the message is printed in ink contrasting with the metal background. Thus, the embodiment of FIG. 9B provides an opportunity for printing and elimination of scoring or incising in the center panel that was not previously recognized.

The seam 24 of FIG. 9B can be subject to further reinforcement techniques, such as crimping, reforming, or multiple laser-welds as disclosed previously.

Figure 10A:
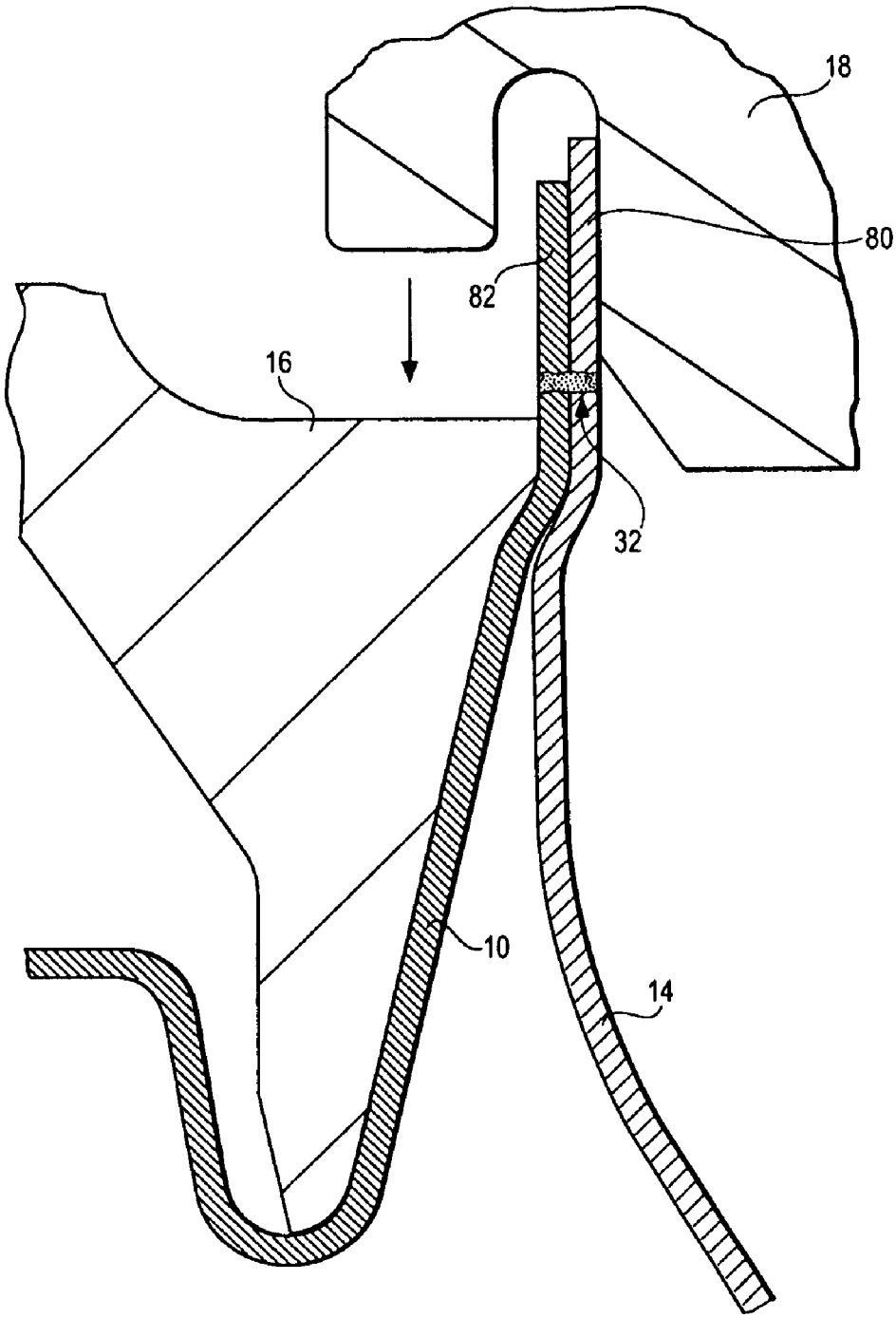
FIG. 10A and 10B are cross-sections of a can end, can body and seam tooling, showing the flange and curl features of the can body and can end before and after a seaming operation in accordance with another embodiment. The seam of FIG. 10B is also particularly useful for providing space for printing in the can in the region of the seam.
Figure 10B:
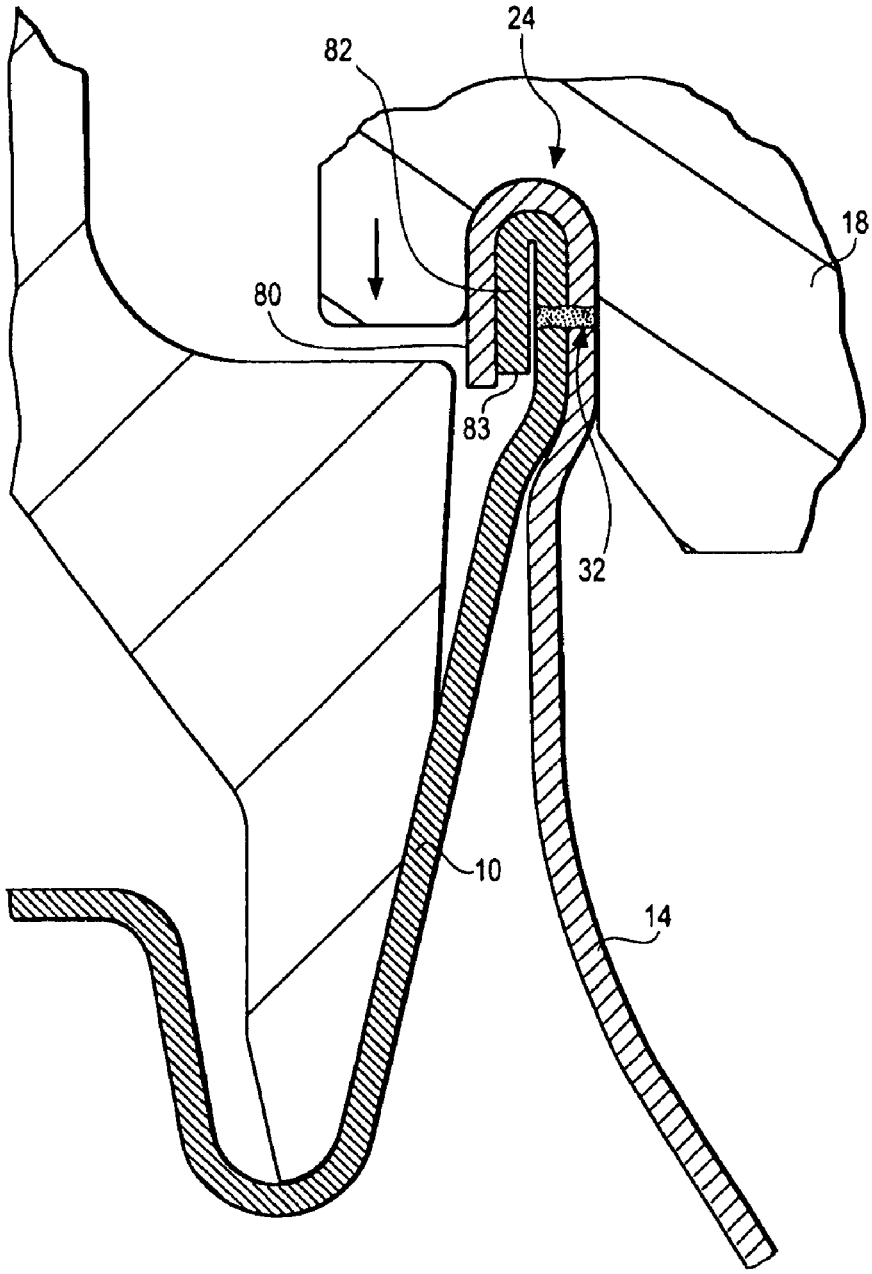

FIGS. 10A and 10B show an alternative embodiment to the embodiment of FIG. 9A and 9B. The can end 10 includes a peripheral edge 82 (FIG. 10A) but it is raised relative to the embodiment of FIG. 9A, as can be seen by a comparison of the Figures. The can body includes the extension portion 80, which may have printing in a preferred embodiment. The manner of forming the seam 24 is the same as explained in FIGS. 9A and 9B. The extension of the edge 82 results in a double folded seam 24, directed inwardly or towards the center of the end 10, as shown in FIG. 10B. The extension 80 of the can body 14 is preferably such that when the seaming operation is completed the extension 80 extends below the level of the edge 83 of the can end 10, so as to provide a seam that is smooth to the touch.

As with the embodiment of FIG. 9B, the joint 24 of FIG. 10B provides an opportunity for printing of the can body 14 to be revealed in the area of the seam 24.

Either before or after the performance of the seaming operation shown in FIG. 10A and 10B, a laser is directed to the area in which the edge 82 and extension 80 are in contact to form a weld 32 fusing the can end to the can body. FIG. 10A shows the weld 32 already in place prior to the seaming operation. Multiple welds as shown in FIG. 8B could be used. In one possible embodiment, the welding operation is performed after the seam 24 of FIG. 10B is formed, e.g., by a laser in a downstream laser station after the completion of the seam 24.

Further reinforcement of the seam by crimping, reforming, or multiple laser welds is possible with the embodiment of FIG. 10B.

It will be further appreciated that we have described a novel arrangement for a can end. As shown in FIG. 7A, we have described a can end having a center panel 100, a peripheral curl portion 30 integral with the center panel 100; and wherein the curl portion 30 is formed such that the curl portion does not curl past a line 102 perpendicular to an axis 104 extending through and perpendicular to the center panel (as shown in FIG. 7A, note that the curl 30 is truncated relative to a prior art curl as shown in FIG. 1A and does not curl downwardly). Note further in FIG. 7A that the curl overlaps and extends substantially beyond a peripheral flange 38 of a can body when the can end 10 is placed over the can body 14 prior to joining the can end to the can body. Further examples of this invention are shown in FIGS. 3A, 4A, 5A, 6A and 8A.

While presently preferred embodiments have been described with particularity, it will be appreciated that variation from the details of the illustrated embodiments are possible without departure from the scope of the invention. This scope is to be determined by reference to the appended claims.

We claim:

1. A method of joining a can end to a can body, comprising:

a) placing the end on the can body, wherein the can body comprises an extension portion having a peripheral edge and wherein the can end comprises a raised peripheral edge and a center, and b) performing a seaming operation to form a seam joining the end to the can body, wherein during the seaming operation the extension portion of the can body and the raised peripheral edge of the can end are folded together inwards towards the center, wherein the flange and peripheral edge are folded such as to provide a double folded seam; and c) reforming the seam whereby the reformed seam is inclined towards a central axis passing through the center of the can end and the can body.

2. The method of claim 1, further comprising the step of welding the can body to the can end using a laser.

3. The method of claim 1, further comprising the step of using a laser to form multiple welds joining the can body to the can end, the welds spaced apart from each other at the seam.

4. A method of joining a can end to a can body, the can body comprising a peripheral flange and the can end comprises a peripheral edge, comprising:

a) placing the end on the can body with the peripheral edge in contact with the peripheral flange;

b) performing a seaming operation so as to form a seam joining the can end to the can body; and c) reforming the seam whereby the seam is inclined towards a central axis passing through the center of the can end and the can body so as to further strengthen the seam;

wherein during the seaming operation of step (b) the flange and peripheral edge are folded together inwardly such as to provide a double folded seam.

5. A method of joining a can end to a can body, comprising:

a) placing the end on the can body, wherein the can body comprises an extension portion having a peripheral edge and wherein the can end comprises a raised peripheral edge and a center, and b) performing a seaming operation to foam a seam joining the end to the can body, wherein during the seaming operation the extension portion of the can body and the raised peripheral edge of the can end are folded together inwards towards the center, wherein the flange and peripheral edge are folded such as to provide a double folded seam; and c) applying printing to the can body which is revealed in the area of the seam, the printing applied such that the printing faces the center of the end after the end is seamed onto the can body.

* * * * *